US007002610B2

(12) United States Patent
Kamoshida et al.

(10) Patent No.: US 7,002,610 B2
(45) Date of Patent: Feb. 21, 2006

(54) IMAGE FORMING APPARATUS

(75) Inventors: Shinichi Kamoshida, Nagano (JP); Kiyoteru Katsuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 162 days.

(21) Appl. No.: 10/704,136

(22) Filed: Nov. 10, 2003

(65) Prior Publication Data

US 2005/0104949 A1 May 19, 2005

(30) Foreign Application Priority Data

Nov. 8, 2002 (JP) ..... P2002-325522
Jan. 17, 2003 (JP) ..... P2003-009617
Jan. 21, 2003 (JP) ..... P2003-012528
Jan. 21, 2003 (JP) ..... P2003-012529

(51) Int. Cl.
*B41J 2/395* (2006.01)

(52) U.S. Cl. ..... 347/148; 347/141

(58) Field of Classification Search ..... 347/141, 347/148, 208, 199; 346/139 C
See application file for complete search history.

(56) References Cited

U.S. PATENT DOCUMENTS 6,518,990 B1 * 2/2003 Koga et al. ..... 347/141
6,532,031 B1 * 3/2003 Koga et al. ..... 347/141
6,618,065 B1 * 9/2003 Koga et al. ..... 347/141
6,661,442 B1 * 12/2003 Koga et al. ..... 347/141
2004/0207713 A1 * 10/2004 Kamoshida et al. ..... 347/208

FOREIGN PATENT DOCUMENTS

JP 2002-113897 A 4/2002
JP 2002-172813 A 6/2002
JP 2002-178554 A 6/2002

* cited by examiner

*Primary Examiner*—Huan Tran
(74) *Attorney, Agent, or Firm*—Sughrue Mion, PLLC

(57) ABSTRACT

A head device is for writing an electrostatic latent image on an image carrier of an image forming apparatus which is movable in a first direction. In the head device, a plurality of writing electrodes are arrayed on a substrate in a second direction perpendicular to the first direction to form a plurality of electrode arrays which are arranged in the first direction. The writing electrodes are brought into contact with the image carrier with a flexibility of the substrate. A head driver is disposed on the substrate. A plurality of wirings are extending in the first direction to connect the head driver and the respective writing electrodes to supply writing voltages from the head driver to the writing electrodes. At least one of the wirings extended through one of the writing electrodes in one of the electrode arrays is placed between adjacent ones of the writing electrodes in another one of the electrode arrays.

3 Claims, 21 Drawing Sheets

IMAGE FORMING APPARATUS

BACKGROUND OF THE INVENTION

The present invention relates to a writing head in which plural arrays of writing electrode are formed on a flexible substrate for forming an electrostatic latent image on a latent the image carrier by applying a writing voltage to the electrode from a head driver. The present invention also relates to an image forming apparatus provided with the writing head.

In an image forming apparatus such as an electrostatic copying machine, a printer, the surface of a photosensitive member is uniformly charged by a charging device, and by exposing light from an exposing device such as a laser or an LED, an electrostatic latent image is formed in the surface of the photosensitive member. Thereafter, through the development of the electrostatic latent image in the surface of the photosensitive member, a developer image is formed on the surface of the photosensitive member. This developer image is transferred to a recording medium such as paper by a transferring device to record an image.

Such an image forming apparatus is likely to be bulky and has a complicated configuration since the exposing device for writing electrostatic latent images must be provided with a light generator.

Hence, there is proposed a head device for writing an electrostatic latent image on an image carrier with voltage applied through electrodes to omit the use of the light generator to downsize or simplify the image forming apparatus.

FIG. 1 shows one example of such a writing head. The writing head 3 is comprised of: a flexible substrate 3*a*; a plurality of strip-shaped wiring patterns 3*c* arrayed on the substrate 3*a* in a widthwise direction of a latent the image carrier 2 (described later); and writing electrodes 3*b* provided at the respective ends of the wiring patterns 3*c* so as to project toward the latent the image carrier 2.

The writing head 3 is manufactured by the following manner. Conductive members to be electrodes 3*b* such as cupper are first bonded on an insulative member to be the substrate 3*a*. Next, photoresist is coated on the conductive members. Next, a mask pattern corresponding to the wiring patterns 3*c* is laminated on the photoresist and an exposing process is performed.

Japanese Patent Publication No. 2002-172813A discloses a writing head (a first related art) in which writing electrodes are arranged in the widthwise direction of the latent the image carrier to form an electrode array, and two electrode arrays are arranged in a rotating direction of the latent the image carrier. Head drivers are disposed at one side or both sides of the two electrode arrays in the rotating direction of the latent the image carrier.

Japanese Patent Publication No. 2002-113897A discloses a writing head (a second related art) in which writing electrodes are pressed against a latent the image carrier with a pressing member or an urging member to establish a large nip width with a weak load.

In the first related art, since there is no wiring pattern at a portion on the substrate between the two electrode arrays, the stiffness of the portion becomes remarkably weaker than any other portions. In a case where stress is concentrated to the weak portion, deformation or creasing of the writing head may be occurred. In such a case, the two electrode arrays are hardly to be abutted against the latent the image carrier uniformly. As a result, electrostatic latent images cannot be correctly formed on the latent the image carrier, causing the deterioration of print quality. Moreover, another problem takes place that the creasing and bending of the writing head act to fluctuate the spacing between the two arrays of writing electrode, and thus giving horizontal streaks in the final image due to pitch fluctuation in the electrostatic latent image.

In the second related art, it cannot sufficiently prevent the bending and creasing of the writing head because the writing head is pressed with an extremely weak load.

Japanese Patent Publication No. 2002-178554A discloses a writing head (a third related art) in which a plurality of writing electrodes are arranged on a flexible base member in the widthwise direction of the latent the image carrier to form an electrode array. An electrostatic latent image is formed by charging the surface of the charge injection layer with predetermined voltage through the writing electrodes, in accordance with an input signal of image information. The writing electrodes are weakly abutted against the surface of a charge injection layer of the latent the image carrier with the flexibility of the base member, so that the abutment condition of the electrodes can be stabilized to securely perform the writing operation of the latent image.

In the third related art, two electrode arrays are arranged in the rotating direction of the latent the image carrier. The writing electrodes of the two electrode arrays are arranged in a zigzag manner such that one electrode in the first array is situated between adjacent electrodes in the second array. Since the electrodes are partially overlapped relative to the rotating direction of the latent the image carrier, non-chargeable region will not be formed on the surface of the latent the image carrier. That is the entire surface of the latent the image carrier is made chargeable.

In this case, the writing electrodes in the array closer to the fixed end of the flexible base member is abutted against the latent the image carrier more strongly than writing electrodes in the array closer to the free end of the flexible base member. Since the stiffness of the portion of the base member between the two electrode arrays is small, an elastic force for separating the electrode array closer to the free end of the base member from the latent the image carrier may act through the electrode army closer to the fixed end of the base member.

In such a case, the contact resistances of the two electrode arrays with respect to the latent the image carrier are made different from each other. In a case where the writing operation is performed by applying the same voltage to the two electrode arrays having different contact resistances, the latent image is deteriorated.

SUMMARY OF THE INVENTION

It is therefore an object of the invention to provide a writing head device capable of eliminating bending and creasing thereof due to the stress concentration, and enabling writing electrodes in individual arrays to stably and evenly contact with a latent the image carrier.

In order to achieve the above object, according to the invention, there is provided a head device, for writing an electrostatic latent image on an image carrier of an image forming apparatus which is movable in a first direction, comprising:

a flexible substrate;

a plurality of writing electrodes, arrayed on the substrate in a second direction perpendicular to the first direction to form a plurality of electrode arrays which are arranged in the first direction, the writing electrodes being brought into contact with the image carrier with a flexibility of the substrate;

a head driver, disposed on the substrate; and a plurality of wirings, extending in the first direction to connect the head driver and the respective writing electrodes to supply writing voltages from the head driver to the writing electrodes.

wherein at least one of the wirings extended through one of the writing electrodes in one of the electrode arrays is placed between adjacent ones of the writing electrodes in another one of the electrode arrays.

Preferably, the number of wirings situated between a portion between the plural electrode arrays is identical with the number of wirings situated between a portion between the head driver and one of the plural electrode arrays.

According to the invention, there is also provided an image forming apparatus, comprising:

an image carrier on which an electrostatic latent image to be developed as a visible image is formed; and the above head device, operable to write the electrostatic latent image on the image carrier.

According to the above configurations, the stiffness of the portion between the two electrode arrays can be increased to stabilize the contact condition of the writing electrodes with respect to the image carrier. As a result the fluctuation of the distance between writing electrodes in the individual arrays can be avoided so that the occurrence of horizontal streaks in the final image can be eliminated.

According to the invention, there is also provided a head device, for writing an electrostatic latent image on an image carrier of an image forming apparatus which is movable in a first direction, comprising:

a flexible substrate, supported in the image forming apparatus in a cantilevered manner;

a plurality of writing electrodes, arrayed on the substrate in a second direction perpendicular to the first direction to form a plurality of electrode arrays which ate arranged in the first direction, the writing electrodes being brought into contact with the image carrier with a flexibility of the substrate; and a contact force equalizer, provided on the substrate to equalize a contact force acting from one of the electrode arrays closer to a free end of the substrate to the image carrier, with a contact force acting from one of the electrode arrays closer to a fixed end of the substrate to the image carrier.

Preferably, the contact force equalizer is at least one weight member which is configured such that a load imparting to one of the electrode arrays closer to a free end of the substrate is greater than a load imparting to one of the electrode arrays closer to a fixed end of the substrate.

According to the invention, there is also provided an image forming apparatus, comprising:

an image carrier on which an electrostatic latent image to be developed as a visible image is formed; and the above head device, operable to write the electrostatic latent image on the image carrier.

According to the above configurations, the contact pressure between electrode arrays and the image carrier can be effectively made equal. Therefore, the contact resistance of each electrode array with respect to the image carrier is made equal, enabling the consistent formation of high quality electrostatic latent images on the image carrier.

Further, since the same voltage can be applied to every electrode array, the voltage control can be facilitated and the use of a high-voltage IC can be avoided.

According to the invention, there is also provided a head device, for writing an electrostatic latent image on an image carrier of an image forming apparatus which is movable in a first direction, comprising:

a flexible substrate, supported in the image forming apparatus in a cantilevered manner;

a plurality of writing electrodes, arrayed on the substrate in a second direction perpendicular to the first direction to form a plurality of electrode arrays which are arranged in the first direction, the writing electrodes being brought into contact with the image carrier with a flexibility of the substrate; and a head driver, operable to apply first writing voltages to the writing electrodes associated with image forming regions, such that an absolute value of a writing voltage applied to one of the electrode arrays closer to a fixed end of the substrate is not greater than an absolute value of a writing voltage applied to one of the electrode arrays closer to a free end of the substrate.

Preferably, the head driver is operable to apply second writing voltages to the writing electrodes associated with non-image forming regions such that an absolute value of a writing voltage applied to one of the electrode arrays closer to a fixed end of the substrate is not greater than an absolute value of a writing voltage applied to one of the electrode arrays closer to a free end of the substrate. Here, a polarity of the second writing voltages is opposite to a polarity of the first writing voltages.

According to the invention, there is also provided an image forming apparatus, comprising:

an image carrier on which an electrostatic latent image to be normally developed as a visible image is formed; and the above head device, operable to write the electrostatic latent image on the image carrier.

According to the invention, there is also provided a head device, for writing an electrostatic latent image on an image carrier of an image forming apparatus which is movable in a first direction, comprising:

a flexible substrate, supported in the image forming apparatus in a cantilevered manner;

a plurality of writing electrodes, arrayed on the substrate in a second direction perpendicular to the first direction to form a plurality of electrode arrays which are arranged in the first direction, the writing electrodes being brought into contact with the image carrier with a flexibility of the substrate; and a head driver, operable to apply first writing voltages to the writing electrodes associated with non-image forming regions, such that an absolute value of a writing voltage applied to one of the electrode arrays closer to a fixed end of the substrate is not greater than an absolute value of a writing voltage applied to one of the electrode arrays closer to a free end of the substrate.

Preferably, the head driver is operable to apply second writing voltages to the writing electrodes associated with image forming regions such that an absolute value of a writing voltage applied to one of the electrode arrays closer to a fixed end of the substrate is not greater than an absolute value of a writing voltage applied to one of the electrode arrays closer to a free end of the substrate. Here, a polarity of the second writing voltages is opposite to a polarity of the first writing voltages.

According to the invention, there is also provided an image forming apparatus, comprising:

an image carrier on which an electrostatic latent image to be reversely developed as a visible image is formed; and the above head device, operable to write the electrostatic latent image on the image carrier.

According to the above configurations, the difference between the contact forces of the writing electrodes with respect to the image carrier is canceled. Since the contact resistances of the writing electrodes with respect to the image carrier are made substantially identical with each other, an uniform electrostatic latent image can be formed. Performing the normal or reversal development with this uniform latent image, a final image with high quality can be stably obtained.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the invention will be described below in detail with reference to the accompanying drawings.

Figure 1:
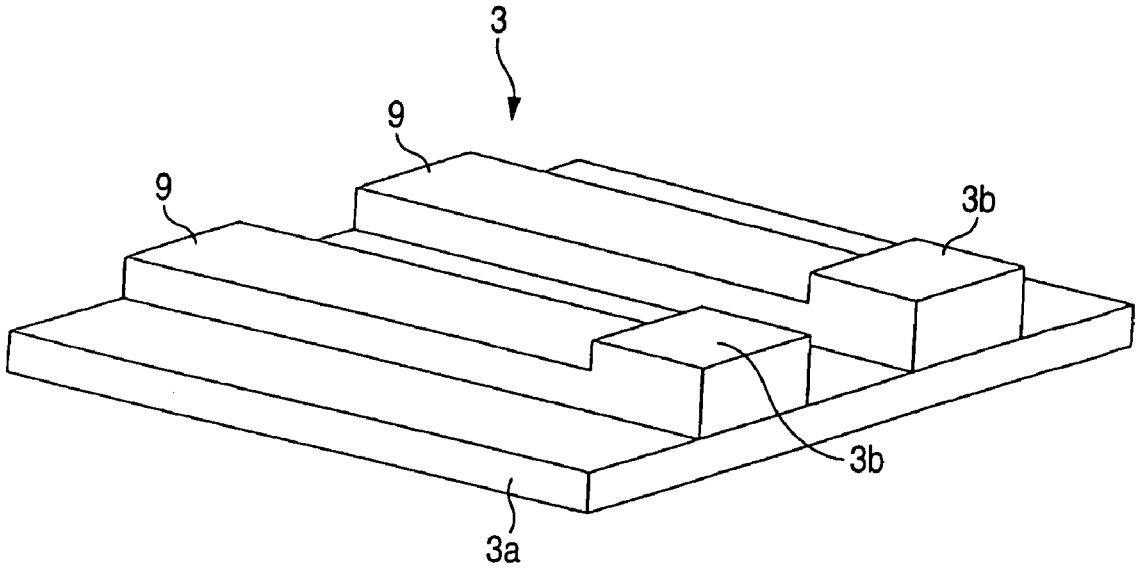
FIG. 1 is a perspective view partly showing the rough structure of a writing head using writing electrodes.
Figure 2:
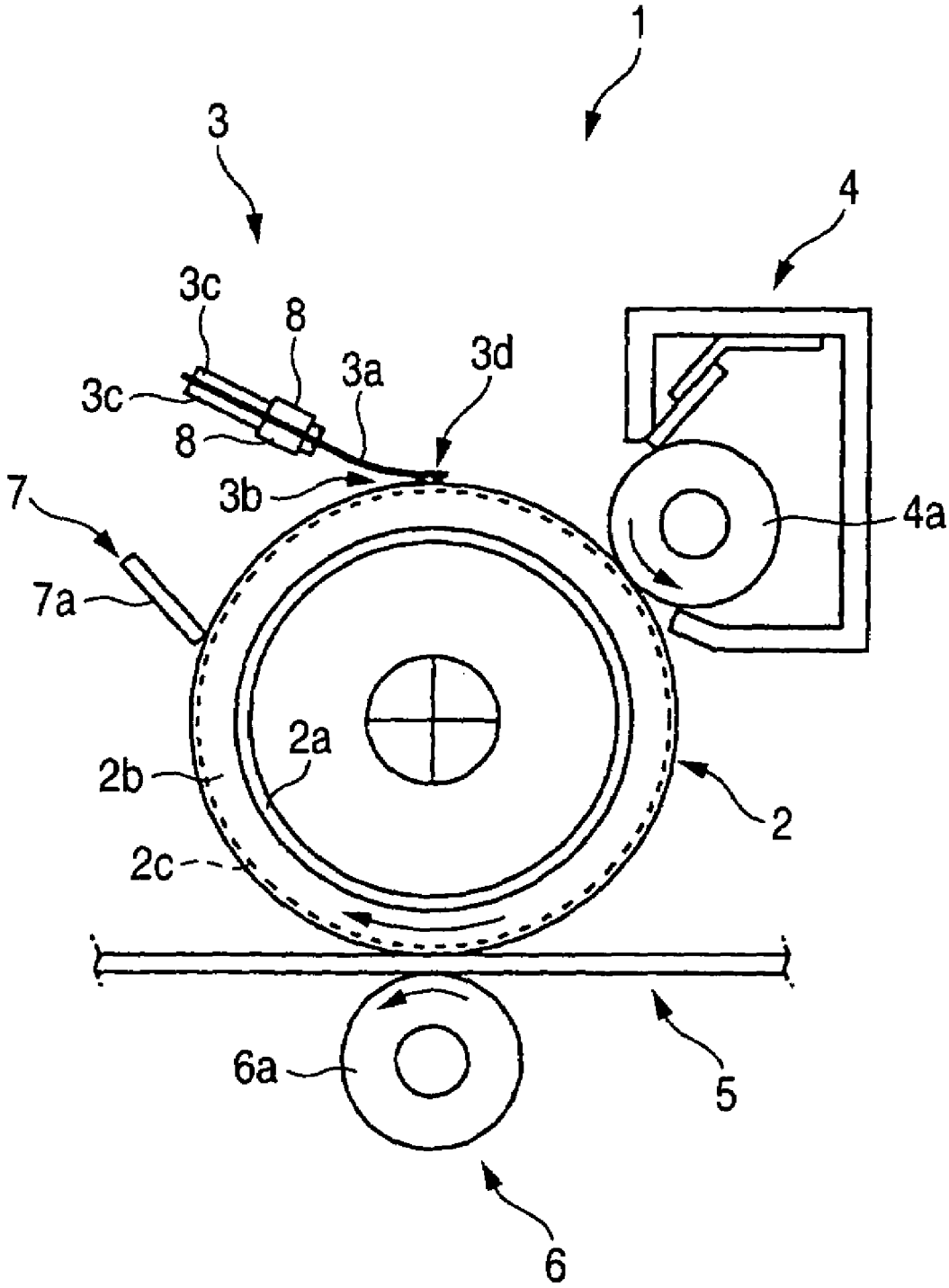
FIG. 2 is a schematic section view showing an image forming apparatus incorporating a writing device according to a first embodiment of the invention.

FIG. 2 shows an image forming apparatus according to a first embodiment of the invention. The image forming apparatus 1 comprises: a rotatable the image carrier 2 on which an electrostatic latent image and a developer image are formed; a writing device 3 which is brought into contact with the image carrier 2 to write the latent image thereon; a developing device 4 which develops the electrostatic latent image on the image carrier 2 with developer (e.g., toner) held oh and carried by a developing roller 4*a*; a transferring device 6 which transfers the developer image from the image carrier 2 onto a recording medium 5 such as paper; and a cleaner 7 having a cleaning blade 7*a* which cleans the surface of the image carrier 2 by removing the toner remaining on the image carrier 2 after the transferring operation.

In this case, development of an electrostatic latent image is of the normal type, and the toner used for the development may be either positively or negatively charged.

The explanation hereinafter assumes that the image carrier 2 is grounded, which however is just for the sake of descriptive convenience. Thus, the invention is not restricted to the case where the image carrier 2 is grounded.

The image carrier 2, which is arranged near the central part of the apparatus and is fabricated into a shape of drum, is composed of a grounded base material 2*a* made of an electro-conductive material such as aluminum, a dielectric layer 2*b* provided along the outer periphery of this base material 2*a*, and a charge injection layer 2*c* made of an electro-conductive film formed in the superficial portion of this dielectric layer 2*b*. By way of precaution, the image carrier 2 may be fabricated in the form of belt.

Figure 3:
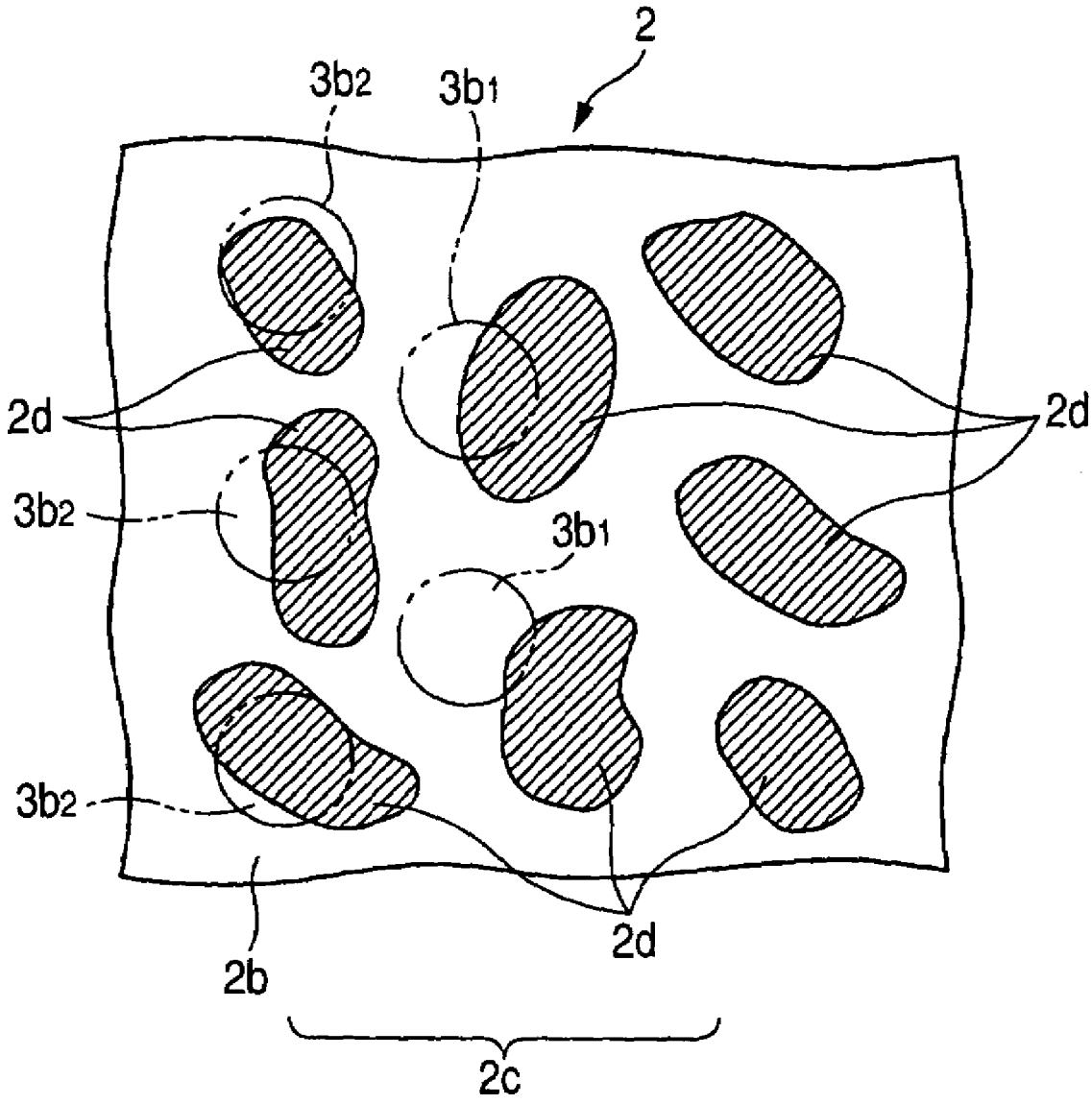
FIG. 3 is an enlarged plan view showing the surface of an image carrier in the image forming apparatus of FIG. 2.

As shown in FIG. 3, an example of the charge injection layer 2*c* has a large number of charge injection regions 2*d* distributed in a dispersed manner and electrically independent from each other in the superficial portion of the dielectric layer 2*b*. These many charge injection regions 2*d* constitute, for example, an island structure in which locally-conductive portions are distributed so as to be electrically independent from one another. The surface of each charge injection region 2*d* is made flush with any other portions of the surface of the superficial part of the dielectric layer 2*b*.

The dielectric layer 2*b*, which serves as the interior of a condenser, is preferably prepared so as to have a predetermined electric resistance (e.g., $10^{15}\Omega$ or less), since it must have a function of holding electrostatic charge on the charge injection region 2*d* of the image carrier 2 in the form of spot. Dielectric materials used for this dielectric layer 2*b* include polyester resins, polycarbonate resins, polyethylene resins, fluorinated resins, cellulose, vinyl chloride resins, polyurethane resins, acrylic resins, epoxy resins, silicone resins, alkyl resins, vinyl chloride-vinyl acetate copolymer resins and polyamide resins (nylon).

On the other hand, as the material for the charge injection region 2*d*, those having an electric resistance lower than that of dielectric layer 2*b* (e.g., $10^{10}\Omega$ or less) are used. In the selection of material, when the electric resistance of charge injection region 2*d* is excessively large, the writing process is influenced by the retardation due to time constant, leading to incorrect latent image writing. Accordingly, the lower electric resistance of charge injection region 2*d* is preferred for the higher process speed.

As the electro-conductive material used for this charge injection region 2*d*, electro-conductive resins or fillers can be used. Materials used to make these electro-conductive resins or fillers include electro-conductive fine particles comprising electro-conductive finely divided polymers such as a polymer complex prepared by doping iodine in polyacetylene, a polymer complex prepared by doping iodine in polythiophine and a polymer complex prepared by doping iodine in polypyrrole, and appropriate combinations of these materials whereby the content of the electro-conductive fine particles or fillers ranges from 10 to 100% by weight to control resistance.

Meanwhile, the charge injection layer 2*c* need not always be of a island structure. Other various structures may be adopted so long as the structure permits the writing of an electrostatic latent image by the writing electrodes 3*b*.

The image carrier 2 is driven by a motor (not shown), is constructed so as to rotate clockwise as shown by the arrow in FIG. 2.

As shown in FIG. 2, the writing device 3 comprises: a substrate 3*a* which is highly insulating, relatively soft, elastic and flexible made of, for example, FPC (Flexible Print Circuit) or PET (polyethylene terephthalate); plural writing electrodes 3*b* which are supported by the substrate 3*a*, brought into light contact with the image carrier 2 by a weak elastic restoration force due to the flexure of substrate 3*a*; a supporter 3*c* which fixes and holds the end of substrate 3*a* positioned at the opposite end of writing electrodes 3*b* to the main body of the image forming apparatus (not shown in the figure), and a driver IC 8 (hereinafter, simply referred as driver) which drives and controls the writing electrodes 3*b* supported by the substrate 3*a*.

The substrate 3*a* is fabricated in the form of rectangular plate arranged in the axial (width) direction of the image carrier 2 with a length roughly equal to the axial direction length of charge injection layer 2*c* of the image carrier 2. This substrate 3*a* is configured so as to extend in the same direction as the rotational direction of the image carrier 2 from left in FIG. 2. By way of precaution, in contrast, the substrate 3*a* may be configured so as to extend in the direction opposite to the advancing direction of the image carrier 2 from right in FIG. 2.

Figure 4A:
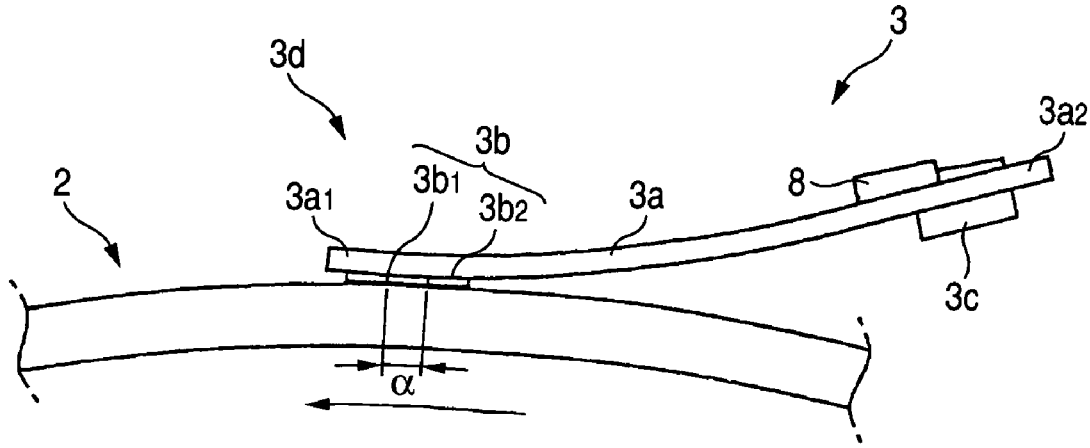
FIG. 4A is a schematic side view showing the writing device of FIG. 2.

As shown in FIG. 3, the writing electrodes 3*b* are arranged to form two arrays, and each array has an arrangement pattern for the case where the plural writing electrodes 3*b* are arranged in the axial (width) direction of the image carrier 2. A writing head 3*d*1 is formed from the plural writing electrodes 3*b*1 in the first array arranged close to the free end 3*a*1 of the substrate 3*a* (the downstream side of the advancing direction of the image carrier 2), and a second writing head 3*d*2 is formed from the plural writing electrodes 3*b*2 in the second array arranged close to the fixed end 3*a*2 of the substrate 3*a* (the upstream side of the advancing direction of the image carrier 2). As shown in FIG. 4A, two writing head arrays 3*d*1, 3*d*2 are separated with a spacing $\alpha$, and writing head unit 3*d* is composed of these arrays of writing heads 3*d*1, 3*d*2.

As shown by a dashed chain line in FIG. 2, the wiring electrodes 3*b*1, 3*b*2 are arranged in a zigzag manner in the width direction of the image carrier 2 such that any adjacent electrode 3*b*1, 3*b*2 are overlapped when viewed from the advancing direction of the image carrier 2. With such an arrangement, uncharged portion that might be formed by the failure in writing by charge injection from writing electrodes 3*b* never occurs, and thus the entire surface of the charge injection region 2*d* can be charged or discharged.

Figure 5A:
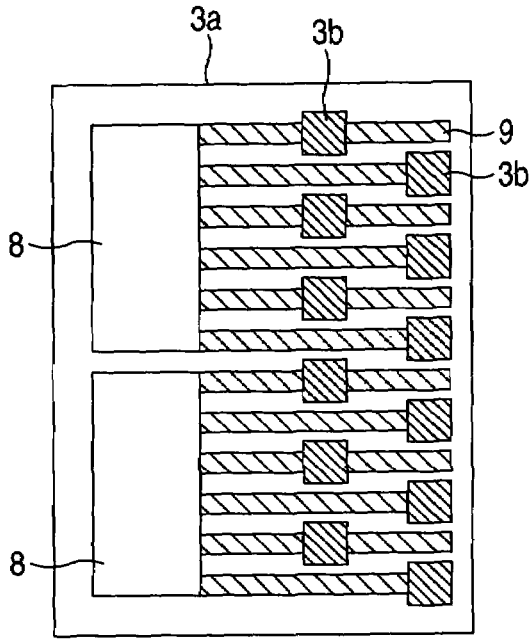
FIG. 5A is a partial plan view showing the writing device of FIG. 2.

In the embodiment, as shown in FIG. 5A, wiring patterns 9 connected to the writing electrodes 3*b* closer to the fixed end of the substrate 3*a* are extended through the writing electrodes 3*b* to the free and of the substrate 3*a*, so that the number of wiring patterns 9 extended from the driver 8 and the number of wiring patterns 9 arranged between the two electrode arrays are made identical. Accordingly, the stiffness of the portion between the two electrode arrays can be increased to stabilize the contact condition of the writing electrodes 3*b* with respect to the image carrier 2. As a result, the fluctuation of the distance between writing electrodes 3*b* in the individual arrays can be avoided so that the occurrence of horizontal streaks in the final image can be eliminated.

In other words, the extended portion of each wiring pattern 9 serves as a reinforcement member that prevents the uneven contact of the wiring electrodes 3*b* due to the stress concentration onto the portion between the two electrode arrays having less stiffness. Since the reinforcement member can be fabricated simultaneously with the fabrication of the wiring patterns 9, the productivity can be improved.

In the situation depicted in FIG. 4A, the substrate 3*a* is elastically bent to some extent and a weak elastic restoration force generates. By this elastic restoration force, the writing electrodes 3*b* are lightly pressed to and brought into contact with the image carrier 2. Since the pressing force of writing electrode 3*b* exerted onto the image carrier 2 is weak, the abrasion of the surface of the image carrier 2 caused by the writing electrodes 3*b* is suppressed, which improves the durability of the image carrier 2. On the other hand, since the writing electrodes 3*b* are in contact with the image carrier 2 by the elastic force of substrate 3*a*, the contact condition can be stabilized.

Figure 4B:
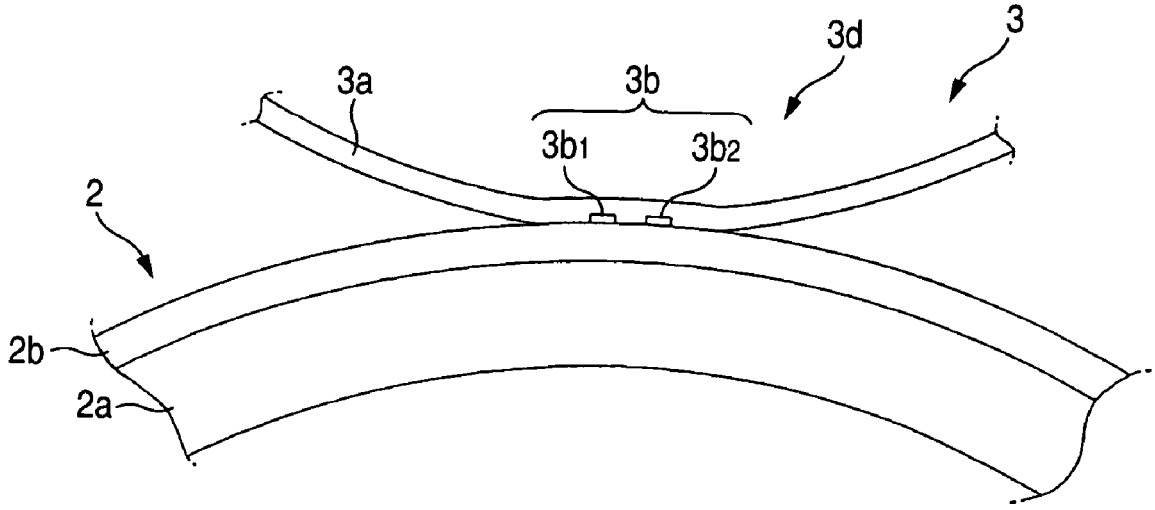
FIG. 4B is a schematic side view showing a writing device according to a second embodiment of the invention.
Figure 5B:
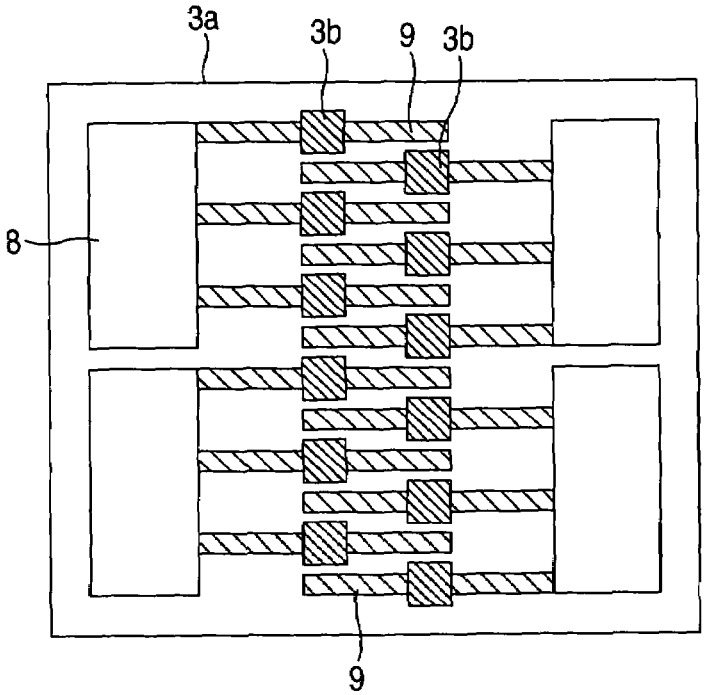
FIG. 5B is a partial plan view showing a writing device of FIG. 4B.

FIGS. 4B and 5B show a second embodiment of the invention in which driver ICs 8 are disposed at both sides of the two electrode arrays in the advancing direction of the image carrier 2.

In this embodiment, since all the wiring patterns 9 are extended through the writing electrodes 3*b* from one side to another. The number of wiring patterns 9 arranged between the two electrode arrays is made twice of the number of wiring patterns 9 extended from the drivers 8 of one side. Therefore, the stiffness of the portion between the two electrodes arrays are made greater than other portions.

In order to make the stiffness even in the entire region of the wiring device, the extended portions of the wiring patterns 9 from the drivers 8 of one side may be omitted so that the number of wiring patterns 9 arranged between the two electrode arrays is made identical with the number of wiring patterns 9 extended from the drivers 8.

Figure 6A:
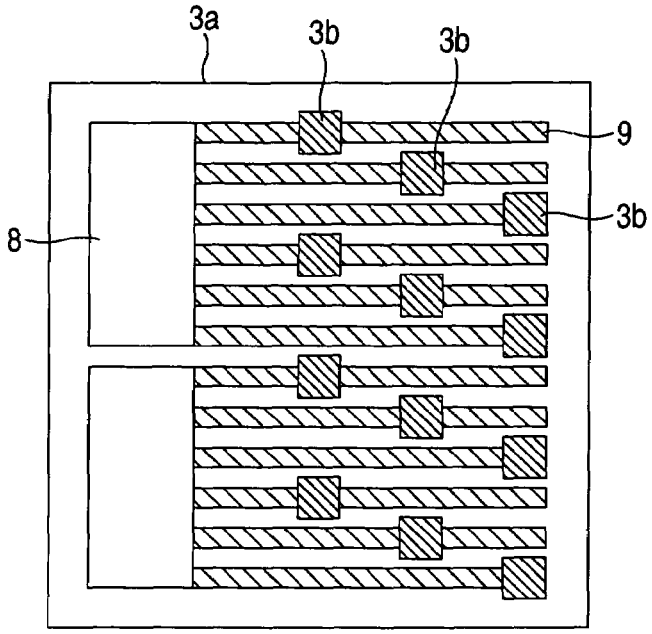
FIG. 6A is a partial plan view showing a writing device according to a third embodiment of the invention.

FIG. 6A shows a third embodiment of the invention, in which the writing electrodes 3*b* are arranged so as to form three electrode arrays.

Figure 6B:
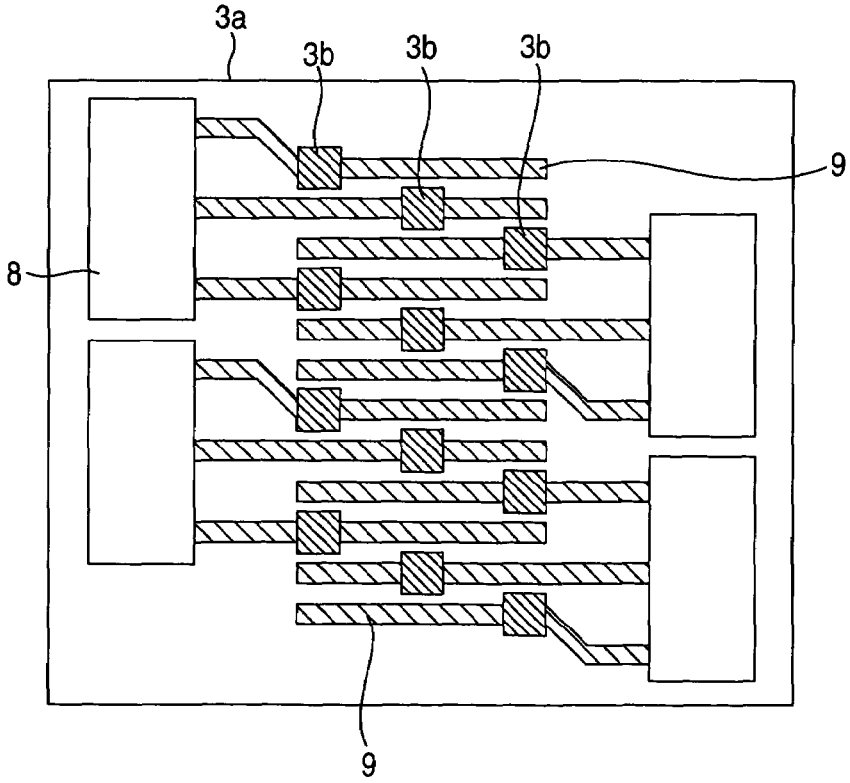
FIG. 6B is a partial plan view showing a writing device according to a fourth embodiment of the invention.

FIG. 6B shows a fourth embodiment of the invention, in which the drivers 8 are disposed at both sides of the three electrode arrays in the advancing direction of the image carrier 2.

Figure 7A:
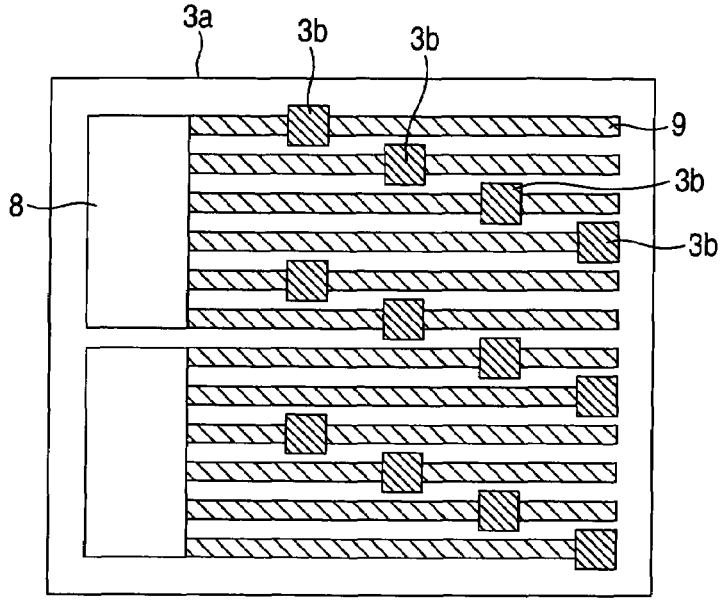
FIG. 7A is a partial plan view showing a writing device according to a fifth embodiment of the invention.

FIG. 7A shows a fifth embodiment of the invention, in which the writing electrodes 3*b* are arranged so as to form four electrode arrays.

Figure 7B:
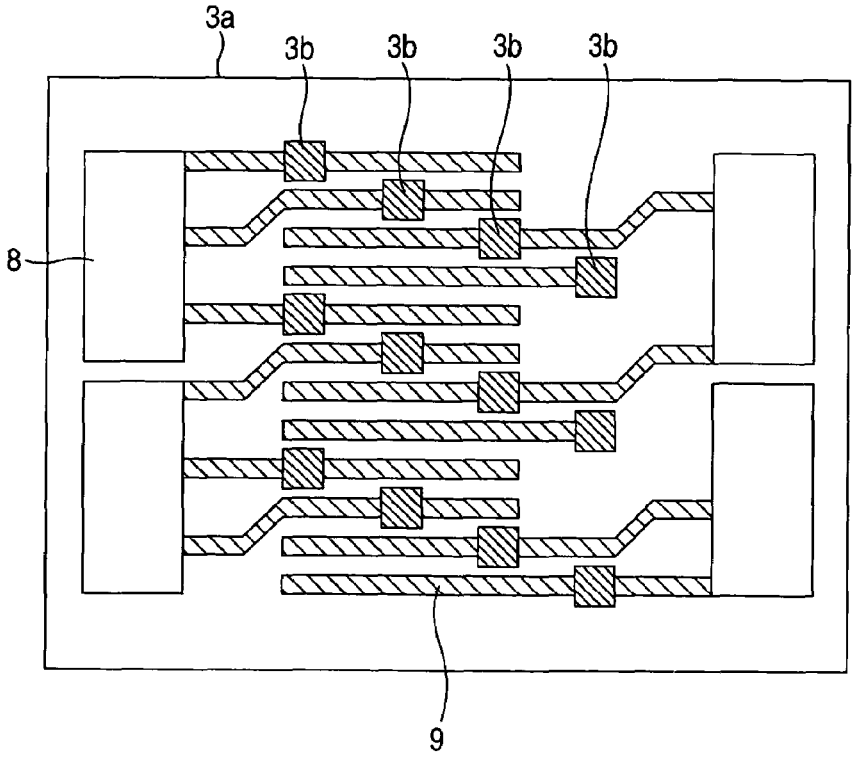
FIG. 7B is a partial plan view showing a writing device according to a sixth embodiment of the invention.

FIG. 7B shows a sixth embodiment of the invention, in which the drivers 8 are disposed at both sides of the four electrode arrays in the advancing direction of the image carrier 2.

In any of the above embodiments, the wiring patterns 9 are extended through the writing electrodes 3*b* so as to reinforce the portion between any adjacent electrode arrays. Therefore, the above described advantages can be attained also in these cases.

Similarly to the second embodiment shown in FIG. 5B, in the configuration shown in FIGS. 6B and 7B, the extended portions of the wiring patterns 9 from the drivers 8 of one side may be omitted so that the number of wiring patterns 9 arranged between the two electrode arrays is made identical with the number of wiring patterns 9 extended from the drivers 8.

Specifically, in the case of FIG. 6B, the extended portions of the wiring pattern 9 from the left drivers 8 may be provided only for the portion between the center electrode array and the left electrode array, while the extended portions of the wiring patterns 9 from the right drivers 8 may be provided only for the portion between the center electrode array and the right electrode array.

In the case of FIG. 7B, the extended portions of the wiring pattern 9 from the left drivers 8 may be provided only for the portion between the left-center electrode array and the left electrode array, while the extended portions of the wiring patterns 9 from the right drivers 8 may be provided only for the portion between the right-center electrode array and the right electrode array. With regard to the portion between the two adjacent center arrays, the extended portion may be provided from either the left drivers or the right drivers.

The configuration is not limited to the above configuration. For example, in addition to the reinforcement member, the substrate 3*a* may be reinforced by integrally bonding a reinforcing member made of an elastic material such as PET and polyimide or a metallic material such as SUS and Cu, or by making the region of interest in the substrate thicker than other regions. Further, the substrate may be fabricated with slits to relatively adjust the strength in the advancing direction of the image carrier 2, or the substrate may be fabricated so as to have a strength anisotropy by fabricating the substrate itself by stretch forming.

Figure 8:
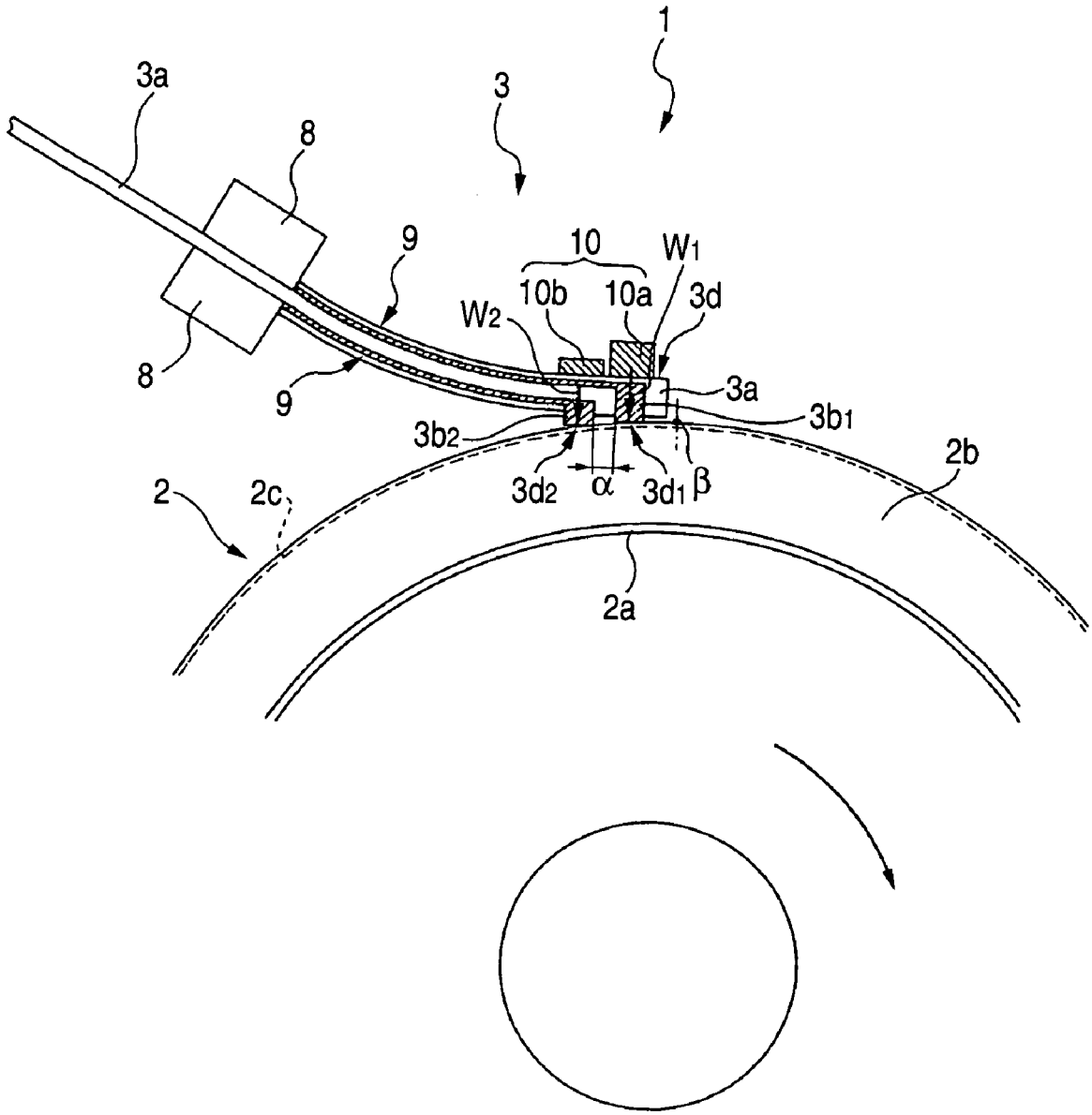
FIG. 8 is a schematic side view showing a writing device according to a seventh embodiment of the invention.

FIG. 8 shows a seventh embodiment of the invention. In this embodiment, each the writing electrode 3*b*1, 3*b*2 in each writing head array 3*d*1 or 3*d*2 has a cylindrically shaped convex part protruding from the substrate 3*a* toward the image carrier 2. Each writing head 3*d*1 or 3*d*2 is arranged in the upstream side of the uppermost (the highest) point β of the image carrier 2 in the advancing direction thereof.

The protruded amount of the writing electrodes 3*b*2 from the substrate 3*a* is set larger than protruded amount of the writing electrode 3*b*1 from the substrate 3*a*, and thus the tips of the writing electrodes 3*b*1, 3*b*2 can be in contact with the surface of the image carrier 2 simultaneously. In this configuration, the tip of each the writing electrode 3*b*1 or 3*b*2 is in contact with the image carrier 2 with a small pressing force exerted by the elasticity of the flexible the substrate 3*a*.

A predetermined number of drivers 8 are arranged on the upper and lower surfaces of the substrate 3*b* in the axial direction of the image carrier 2. As shown in FIG. 2A, the driver 8 on either one side of the substrate 3*a* may be omitted.

In this embodiment, a plurality of groups, each of which consists of a predetermined number (10 in the illustrated case) of contiguous the writing electrodes 3*b*1 in the first array are connected to one driver 8 provided on the upper surface of the substrate 3*a*, are arranged in the axial direction of the image carrier 2. And, a plurality of groups, each of which consists of a predetermined number of contiguous the writing electrodes 3*b*2 in the second array are connected to one driver 8 provided on the lower surface of the substrate 3*a*, are arranged in the axial direction of the image carrier 2.

In such configuration, the writing electrodes 3*b* of a group corresponding to each driver 8 are electrically connected together by a wiring pattern 9 consisting of a thin plate foil made of cupper or the like having a rectangular cross-section but independently of the other groups of the writing electrodes 3*b*. At the same time, each driver 8 is electrically connected with each other by an wiring pattern similar to the wiring pattern 9 and formed on the substrate 3*a*, though the pattern is not illustrated in the figure. These wiring patterns 9 can be fabricated by any of the conventional thin film forming methods such as etching.

At the time of latent image writing, line data, writing timing signals and a high voltage power are fed via a wiring pattern to each driver 8. Moreover, from each driver 8 to the corresponding the writing electrodes 3*b*1 or 3*b*2, predetermined voltages V1 and V2 are selectively fed via the wiring patterns 9.

Since the technique for selective feeding of these predetermined voltages to each the writing electrode 3*b* is disclosed in Japanese Patent Publication No. 2002-178554A, and does not directly relate to the invention, any explanation thereof is omitted in the present specification.

Latent image writing by the writing device 3 onto the image carrier 2 is carried out by the charge injection between the charge injection region 2*d* and the writing electrodes 3*b*. This charge injection is conducted through the contact of the writing electrode 3*b* with a large number of charge injection regions 2*d*. As for the present charge injection, there are cases where charges are injected from the writing electrode 3*b* to the charge injection regions 2*d*, and from the charge injection regions 2*d* to the writing electrode 3*b*. In the former case, the image carrier 2 is charged while the image carrier 2 is discharged in the latter case.

The size of the conductive fine particles used for charge injection region 2*d* and the dimension of the writing electrode 3*b* are closely related to the latent image formation. That is, in a case where the contact area of the writing electrode 3*b* with charge injection layer 2*c* is larger than cross-section of the conductive fine particles, the conductive fine particles in the contact portion of the writing electrode 3*b* are injected with certainty. Thus, the electrostatic latent image to be written in the image carrier 2 can be reproduced without failure, causing the accuracy of latent image writing to improve.

Further, the shape of the convex part is not restricted to cylindrical form, but can include part of a sphere, cone, truncated cone, elliptic cylinder (a pole with an elliptic horizontal section), elliptic cone (a cone with an elliptic horizontal section), truncated elliptic cone (a truncated cone with an elliptic horizontal section), racetrack pole (a pole with a racetrack horizontal section), racetrack cone (a cone with a racetrack horizontal section), truncated racetrack cone (truncated cone with a racetrack horizontal section), triangular prism, triangular pyramid, truncated triangular pyramid, quadratic prism, quadratic pyramid, truncated quadratic pyramid, pentagonal or more multiangular prisms, pentagonal or more multiangular cones, and truncated pentagonal or more multiangular pyramids.

The essential condition for the material of the writing electrode 3*b* is conductive. Here, the electric resistance is regulated so as to lie in a predetermined resistance region (e.g., $10^{15}\Omega$ or less). When the electric resistance is excessively large, imperfect latent image writing occurs under the retardation effect at the writing electrode 3*b* due to time constant, similarly to the previously described issue for charge injection region 2*d*. Accordingly, the lower electric resistance is preferred for the higher speed processing.

In this embodiment, a contact force equalizer 10 which presses the substrate 3*a* toward the image carrier 2 so as to equalize contact forces of the writing heads 3*d*1, 3*d*2 with respect to the image carrier 2. This contact force equalizer 10 consists of weights 10*a* and 10*b* fixed on the substrate 3*a* and each corresponding to each electrode array 3*d*1 or 3*d*2. In this embodiment, the two weights 10*a* and 10*b* are fabricated as separate two members.

The weight 10*a* for the first array presses this writing head 3*d* to the surface of the image carrier 2 by imparting its own weight mainly onto the writing head 3*d*1 forming the first array via substrate 3*a*, and the weight 10*b* for the first array presses the writing head 3*d* to the surface of the image carrier 2 by imparting its own weight mainly onto the first electrode array 3*d*2 via substrate 3*a*. Here, the weight W1 imparted by the weight 10*a* is set larger than weight W2 imparted by the weight 10*b* (W1<W2). With such a setting, the contact pressures of all the electrode arrays 3*d*1, 3*d*2 onto the image carrier 2 become constant or substantially constant.

Figure 9A:
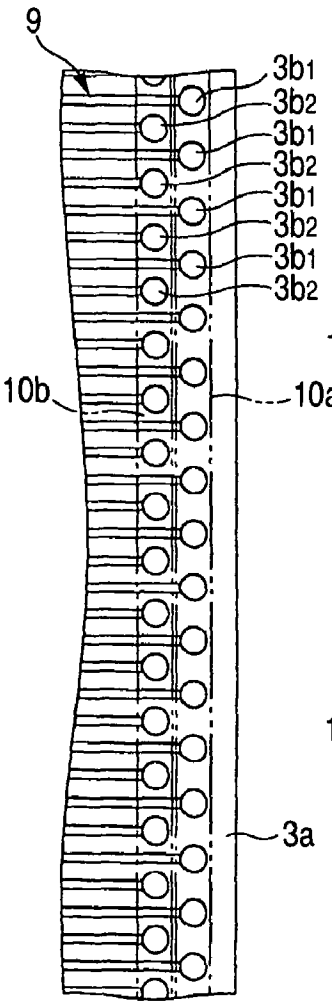
FIGS. 9A to 9D are plan views showing examples of how to arrange weights on a substrate of the wiring device of FIG. 8.

As shown in FIG. 9A, one weight 10*a* or 10*b* is provided for each electrode array 3*d*1 or 3*d*2. In other words, weight 10*a* corresponds to all the writing electrodes 3*b*1 in the first electrode array 3*d*1 and weight 10*b* corresponds to all the writing electrodes 3*b*2 in the second electrode array 3*d*2.

Figure 9B:
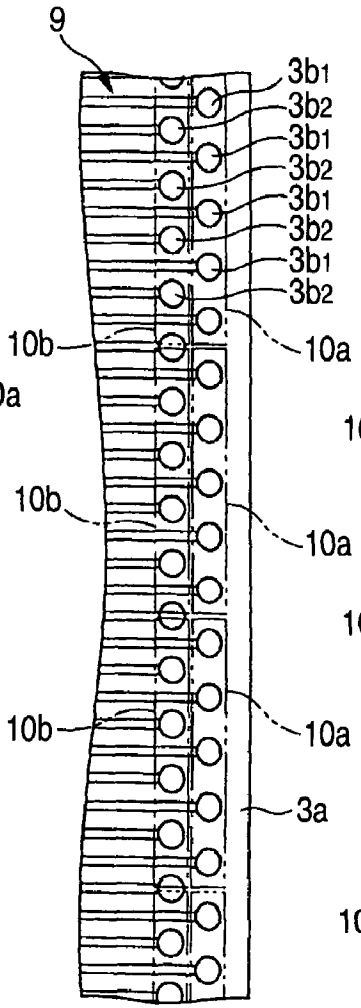

FIG. 9B shows a first modified example of the weight arrangement. In this case, a plurality of weights 10*a* or 10*b* are provided for each electrode array 3*d*1 or 3*d*2. Each of the weights 10*a* and 10*b* are aligned when viewed from the advancing direction of the image carrier 2. Each weight 10*a* or 10*b* is provided so as to correspond a pre-determined number (five in the illustrated case) of the writing electrodes 3*b*1 or 3*b*2 in each electrode array 3*d*1 or 3*d*2.

Figure 9C:
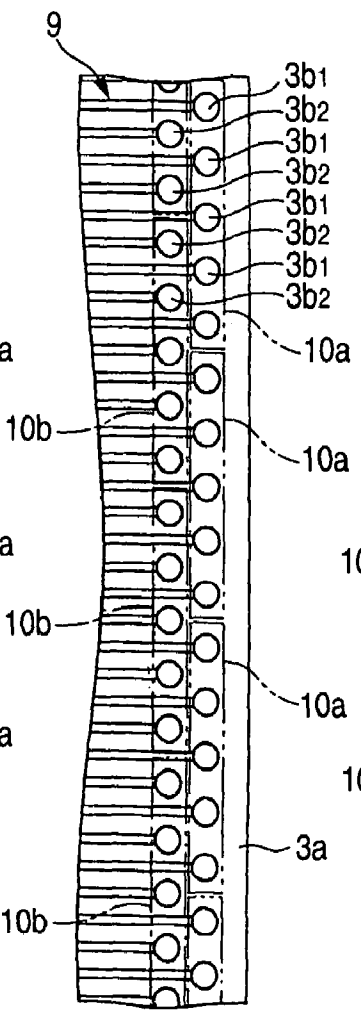

FIG. 9C shows a second modified example of the weight arrangement. In this case, a plurality of weights 10*a* or 10*b* are provided for each electrode array 3*d*1 or 3*d*2, and the weights 10*a* and 10*b* are arranged in a zigzag manner.

Figure 9D:
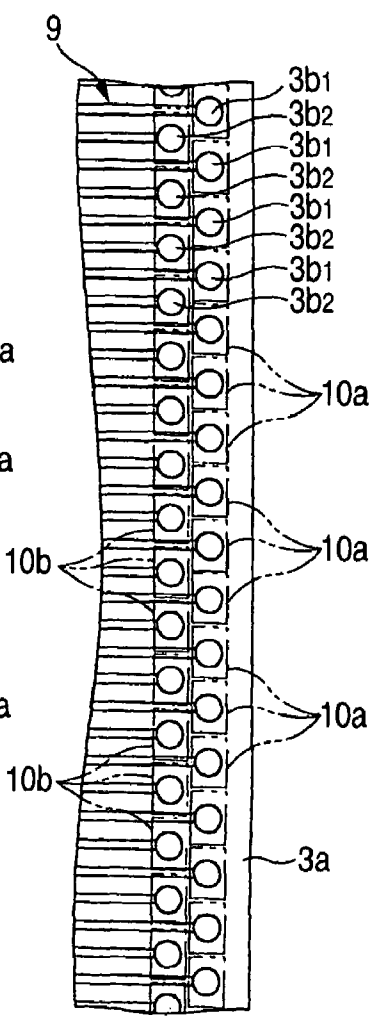

FIG. 9D shows a third modified example of the weight arrangement. In this case, weights 10*a* or 10*b* of the same number as that of the writing electrodes 3*b*1 or 3*b*2 in each electrode array 3*d*1 or 3*d*2 are provided. In other words, the plural weights 10*a* or 10*b* for each array are provided so that one weight is allotted to each the writing electrode 3*b*1 or 3*b*2.

Arbitrary arrangements other than those shown in FIGS. 9A to 9D can be adopted as the arrangement of weight 10*a* and 10*b* so long as the arrangement acts to substantially equalize the contact pressures of electrode arrays 3*d*1, 3*d*2 to the image carrier 2.

According to the above described configuration, the contact pressures of the two electrode arrays 3*d*1, 3*d*2 onto the image carrier 2 are made substantially constant. Thus, the contact pressure between electrode arrays 3*d*1, 3*d*2 and the image carrier 2 can be effectively made equal. Therefore, the contact resistance of each writing head 3*d*1 or 3*d*2 with respect to the image carrier 2 is made equal, enabling the consistent formation of high quality electrostatic latent images on the image carrier 2.

As described the above, since the protruded amounts of the writing electrodes 3*b*1, 3*b*2 so as to correspond to the outer periphery of the image carrier 2, the contact pressure of the respective electrode arrays 3*d*1, 3*d*2 with respect to the image carrier 2 are equalized more effectively.

In such a case, since the same voltage can be applied to every electrode array, the voltage control can be facilitated and the use of a high-voltage IC can be avoided. As a result, production cost can be reduced even if a plurality of electrode arrays are provided.

Furthermore, since the contact force equalizer is realized by the weights 10*a* and 10*b*, the contact pressure between each electrode array and the image carrier 2 can be equalized with a simple configuration.

Moreover, since each of the weights is fabricated as a separate member for each of the two writing head of each array 3*d*1 or 3*d*2, the contact pressure of the writing head of each array 3*d*1 or 3*d*2 to the image carrier 2 can be equalized more efficiently.

Figure 10:
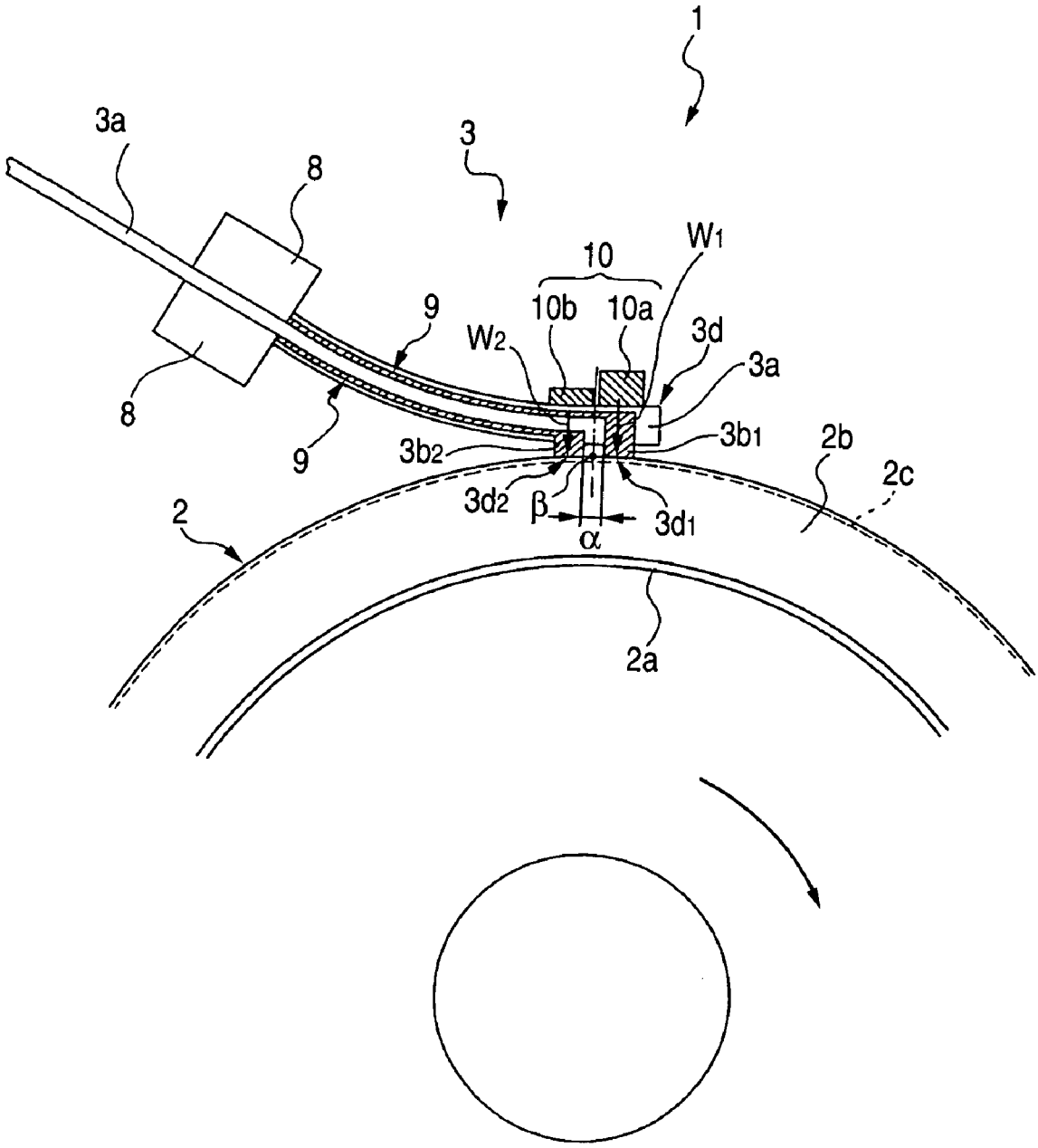
FIG. 10 is a schematic side view showing a writing device according to an eighth embodiment of the invention.

FIG. 10 shows an eighth embodiment of the invention. Hereafter, elements similar to those in the seventh embodiment are designated by the same reference numerals, and repetitive explanations for those will be omitted.

This embodiment is characterized in that the center of the spacing $\alpha$ between writing heads 3*d*1, 3*d*2 is positioned at the highest point $\beta$ of the image carrier 2. Accordingly, the first electrode array 3*d*1 contacts with the image carrier 2 at the downstream side of the highest point $\beta$ in the advancing direction, and the second electrode array 3*d*2 contacts with the image carrier 2 at the upstream side of the highest point $\beta$ in the advancing direction.

Also in this embodiment, a separate weight 10*a* or 10*b* is individually provided on the substrate 3*a* corresponding to each electrode array 3*d*1 or 3*d*2. Accordingly, the weight 10*a* on the substrate 3*a* is arranged at the downstream side of the uppermost point $\beta$ of the image carrier 2 in its advancing direction, and the weight 10*b* on the substrate 3*a* is arranged at the upstream side of the uppermost point $\beta$ of the image carrier 2 in its advancing direction.

Also in this embodiment, load W1 imparted mainly by the weight 10*a* onto the first electrode array 3*b*1 is set larger than load W2 imparted mainly by the weight 10*b* onto the second electrode array 3*b*1 (W2<W1). Due to the circular cross-section of the outer periphery of the image carrier 2, at the contact position of the first electrode array 3*d*1 with the image carrier 2, the outer periphery of the image carrier 2 moves apart from writing head 3*d*1. Thus, the contact force of the first electrode array 3*d*1 to the image carrier 2 reduces compared with that in the seventh embodiment. Therefore, the load W1 imparted to the first electrode array 3*b*1 is preferably set larger than the load W1 in the seventh embodiment.

In this embodiment, the protruded amounts of the writing electrodes 3*b*1, 3*b*2 may be made almost equal to each other. However, as described the above, by using the second electrode array 3*d*2 in contact with the image carrier 2 as a support point, the substrate 3*a* at the gap between electrode arrays 3*d*1, 3*d*2 act to separate the first electrode array 3*d*1 from the image carrier 2. Thus, it is preferable to make the protruded amount of the writing electrodes 3*b*1 in the first array slightly longer than protruded amount of the writing electrodes 3*b*2 in the second array. By fabricating the protruded amounts in such a manner, the contact pressure between each writing head 3*d*1 or 3*d*2 and the image carrier 2 can be made uniform more effectively.

Any other configurations and attained advantages are the same as those described in the seventh embodiment.

Figure 11:
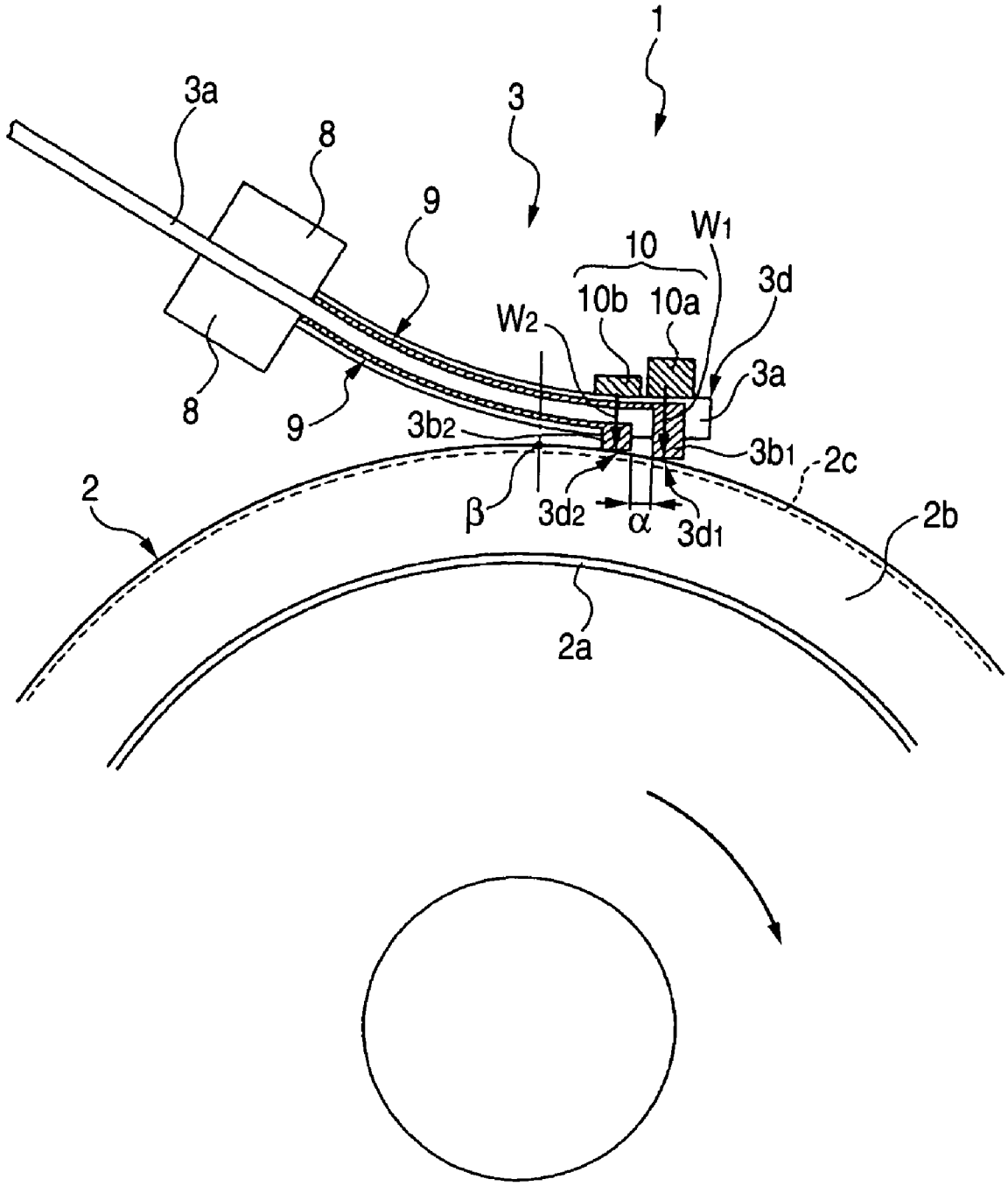
FIG. 11 is a schematic side view showing a writing device according to a ninth embodiment of the invention.

FIG. 11 shows a ninth embodiment of the invention. This embodiment is characterized in that both of electrode arrays 3*d*1, 3*d*2 are in contact with the image carrier 2 at the downstream side of the uppermost point β of the carrier in the advancing direction. Also in this embodiment, separate weights 10*a* and 10*b* are provided on the substrate 3*a* corresponding to the electrode arrays 3*d*1, 3*d*2 in the same manner as in the seventh embodiment.

Also in this embodiment, load W1 imparted mainly by the weight 10*a* onto the first electrode array 3*b*1 is set larger than load W2 imparted mainly by the weight 10*b* onto the second electrode array 3*b*1 (W2<W1). Due to the circular cross-section of the outer periphery of the image carrier 2, at the contact position of the first electrode array 3*d*1 with the image carrier 2, the outer periphery of the image carrier 2 moves apart from writing head 3*d*1. Thus, the contact force of the first electrode array 3*d*1 to the image carrier 2 reduces compared with that in the seventh embodiment. Therefore, the load W1 imparted to the first electrode array 3*b*1 is preferably set larger than the load W1 in the seventh embodiment.

In this embodiment, the protruded amount for the writing electrodes 3*b*1 in the first array is preferably made longer than that for the writing electrodes 3*b*2 in the second array. By fabricating the protruded amounts in such a manner, the contact pressure between each writing head 3*d*1 or 3*d*2 and the image carrier 2 is made uniform more effectively.

Any other configurations and attained advantages are the same as those described in the seventh embodiment.

Figure 12:
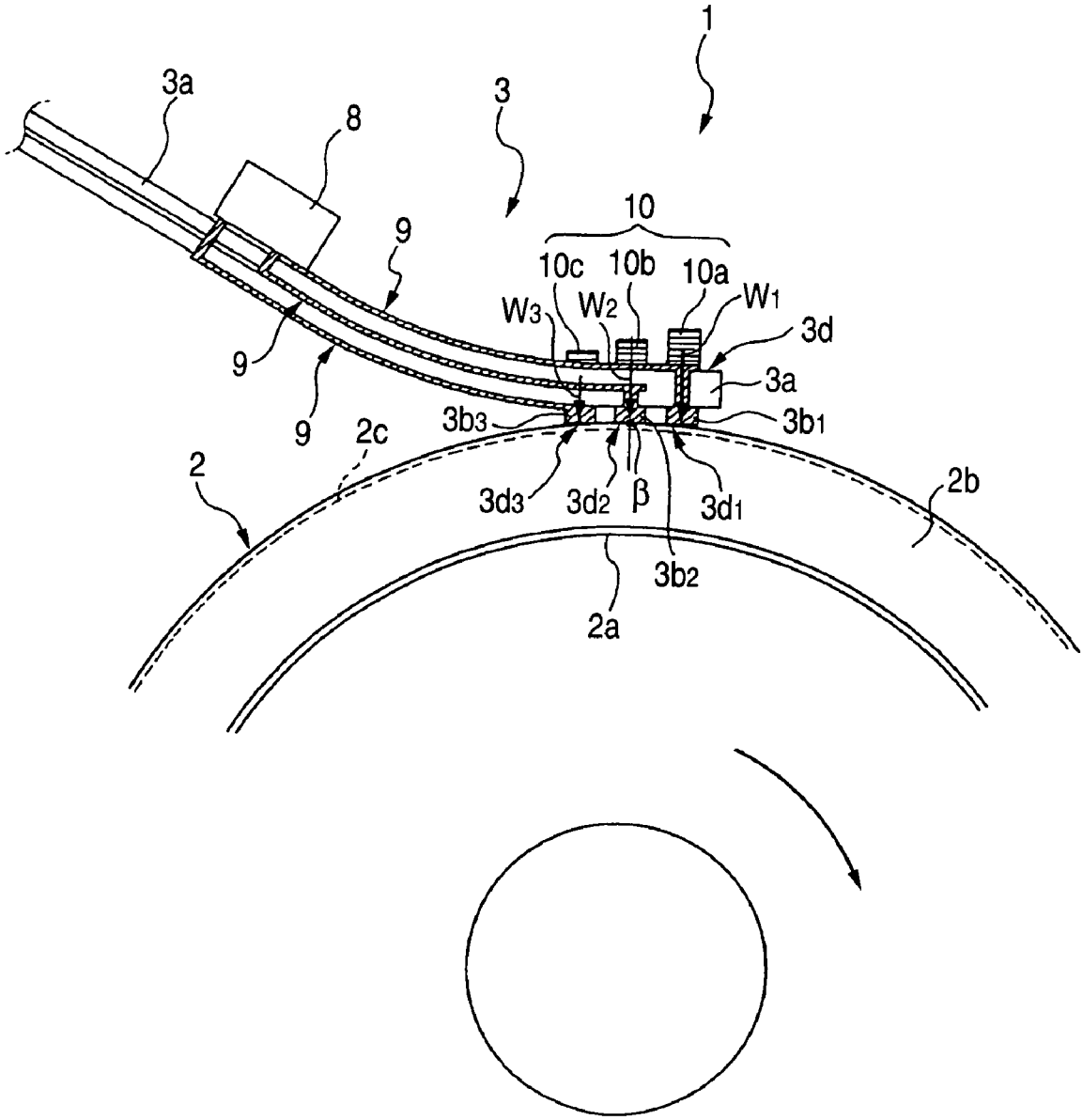
FIG. 12 is a schematic side view showing a writing device according to a tenth embodiment of the invention.

FIG. 12 shows a tenth embodiment of the invention. This embodiment is characterized in that three electrode arrays 3*d*1, 3*d*2 and 3*d*3 are provided on the substrate 3*a* with a predetermined spacing in the advancing direction of the image carrier 2. The center of writing head 3*d* in the advancing direction of the image carrier 2 (i.e., the center of the second electrode array 3*d*2 in the advancing direction of the image carrier 2) is positioned at the highest point β of the image carrier 2. Accordingly, the first electrode array 3*d*1 contacts with the image carrier 2 at the downstream side of the highest point β in the advancing direction, the second electrode array 3*d*2 contacts with the image carrier 2 at the highest point β of the image carrier 2, and the third electrode array 3*d*3 contacts with the image carrier 2 at the upstream side of the highest point β in the advancing direction.

Figure 13A:
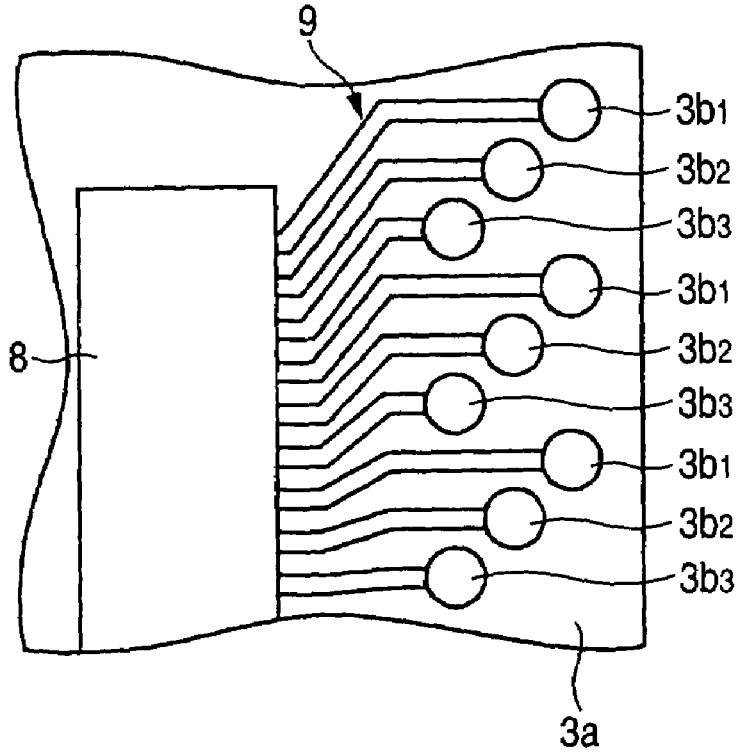
FIGS. 13A and 13B are plan views showing examples of how to arrange writing electrodes of the writing device of FIG. 12.
Figure 13B:
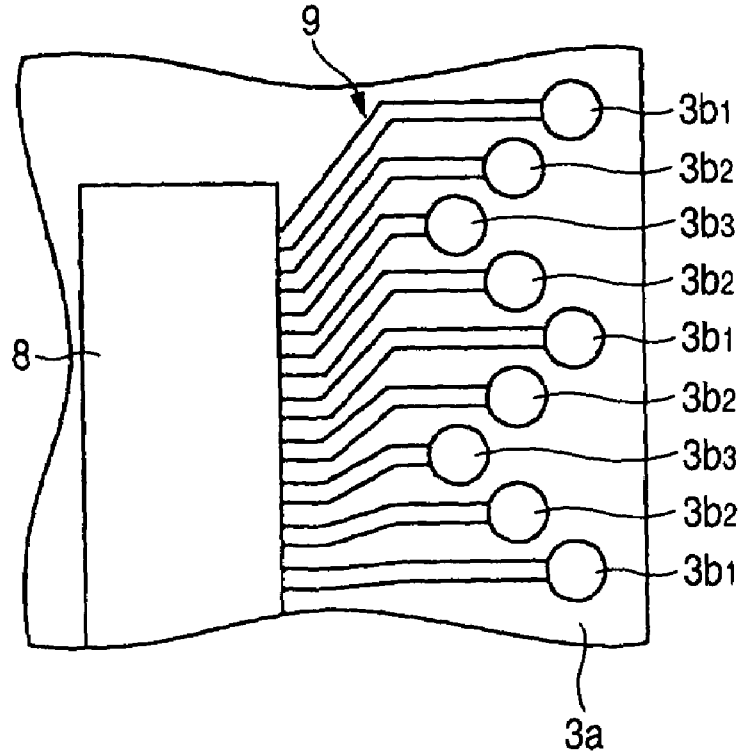

Each electrode array 3*d*1, 3*d*2 or 3*d*3 has plural the writing electrodes 3*b*1, 3*b*2 or 3*b*3 aligned in the axial direction of the image carrier 2. The arrangements shown in FIGS. 13A and 13B may be adopted. Any other arrangement may be adopted so long as the adjacent electrodes are partly overlapped when viewed from the advancing direction of the image carrier 2.

Each the writing electrode 3*b*1, 3*b*2 or 3*b*3 is electrically connected to the driver 8 by the wiring patterns 9.

A separate weight 10*a*, 10*b* or 10*c* is individually provided on the substrate 3*a* corresponding to each electrode array 3*d*1, 3*d*2 or 3*d*3. Accordingly, the weight for the first array 10*a* is arranged at the downstream side of the uppermost point β of the image carrier 2 in its advancing direction, the weight for the second array 10*b* is arranged at the highest point β of the image carrier 2, and the weight for the third array 10*c* is arranged at the upstream side of the uppermost point β of the image carrier 2 in its advancing direction.

Each load W1, W2 or W3 imparted to each writing head 3*d*1, 3*d*2 or 3*d*3 by each weight 10*a*, 10*b* and 10*c* for each array is set so as to increase stepwise from the third array to the first array in this order (W3<W2<W1).

Any other configurations and attained advantages are the same as those described in the seventh embodiment.

In the embodiment, the protruded amounts of the writing electrodes 3*b*1, 3*b*2 and 3*b*3 in electrode arrays 3*d*1, 3*d*2 and 3*d*3 may be made almost equal to each other. However, it is preferable to make the protruded amounts of the writing electrodes 3*b*1 and 3*b*3 in the first and third arrays slightly longer than protruded amount of the writing electrodes 3*b*2 in the second array, in accordance with the outer peripheral shape of the image carrier 2. By fabricating the protruded amounts in such a manner, the contact pressure between each writing head 3*d*1, 3*d*2 or 3*d*3 and the image carrier 2 can be equalized more effectively.

Although the drivers 8 are provided only on the upper surface of the substrate 3*a*, drivers 8 can be provided only on the lower surface of the substrate 3*a*, and on both surface of the substrate 3*a*.

The center of the writing head may be arranged deviated to the upstream or downstream side of the highest point β of the image carrier 2 in the advancing direction thereof.

Figure 14:
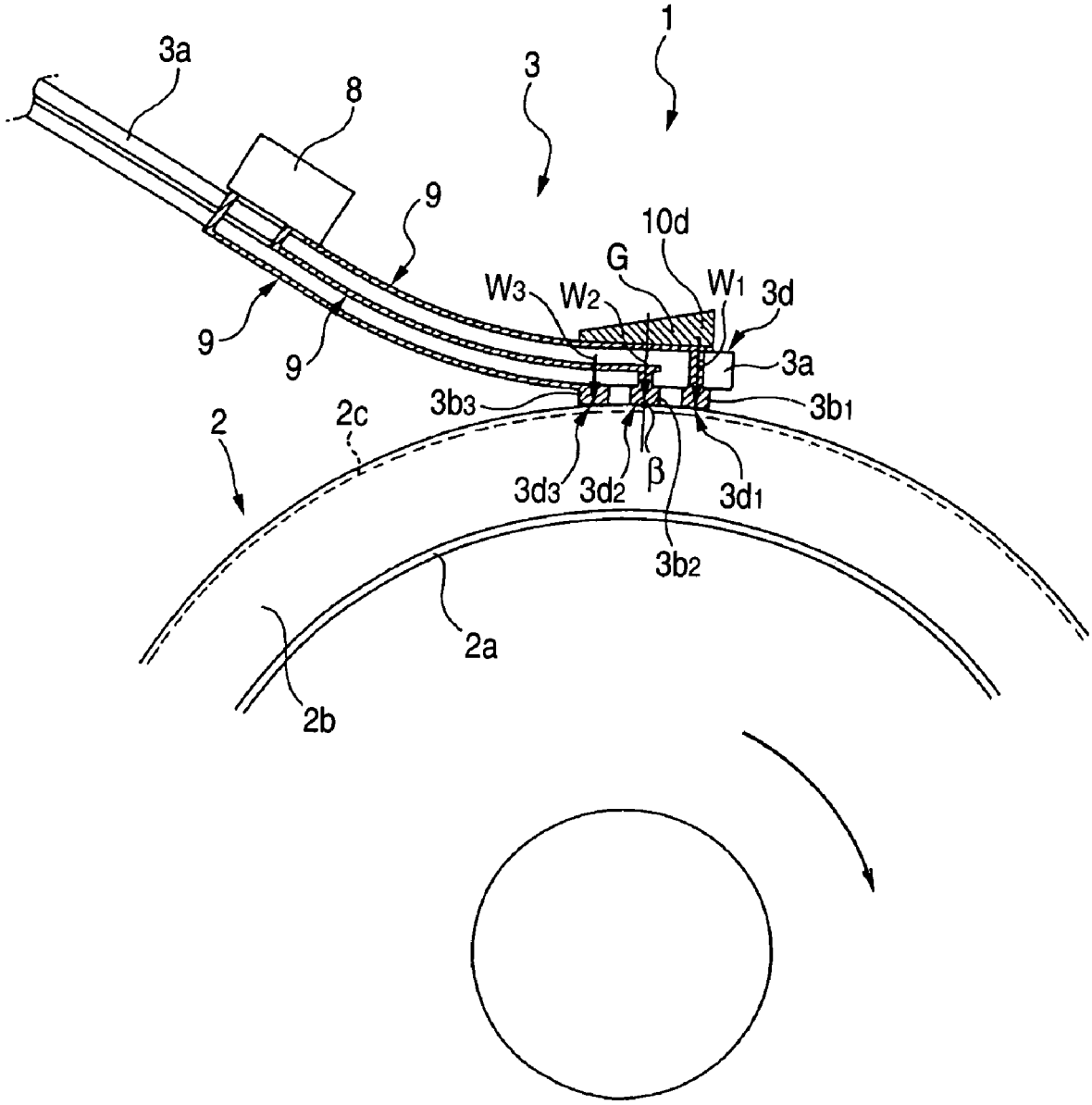
FIG. 14 is a schematic side view showing a writing device according to an eleventh embodiment of the invention.

FIG. 14 shows an eleventh embodiment of the invention. This embodiment is characterized in that the weights for each array are unified to form a weight 10*d*. Further, the thickness of the weight 10*d* resulting from the unification of the individual arrays is so designed as to continuously become thicker toward the downstream side from the upstream side in the advancing direction of the image carrier 2. Accordingly, the center of gravity G of weight 10*d* deviates from the second electrode array 3*d*2 toward the first electrode array 3*d*1. Thus load W1, W2 or W3 imparted by weight 10*d* onto each writing head 3*d*1, 3*d*2 or 3*d*3 changes so as to continuously increase from the upstream side to the downstream side of the image carrier 2 (W3<W2<W1).

As the method of arranging weight 10*d* for this fifth example, for example, those shown in FIGS. 5A and B may be adopted.

According to the above configuration, since the weight 10*d* is fabricated integrally covering all the plural electrode arrays 3*b*1, 3*b*2 and 3*b*3, the fixing operation of weight onto the substrate is simplified. The arrangement of the weight 10*d* may be the ways shown in FIG. 9A or 9B.

Any other configurations and attained advantages are the same as those described in the seventh embodiment.

Figure 15:
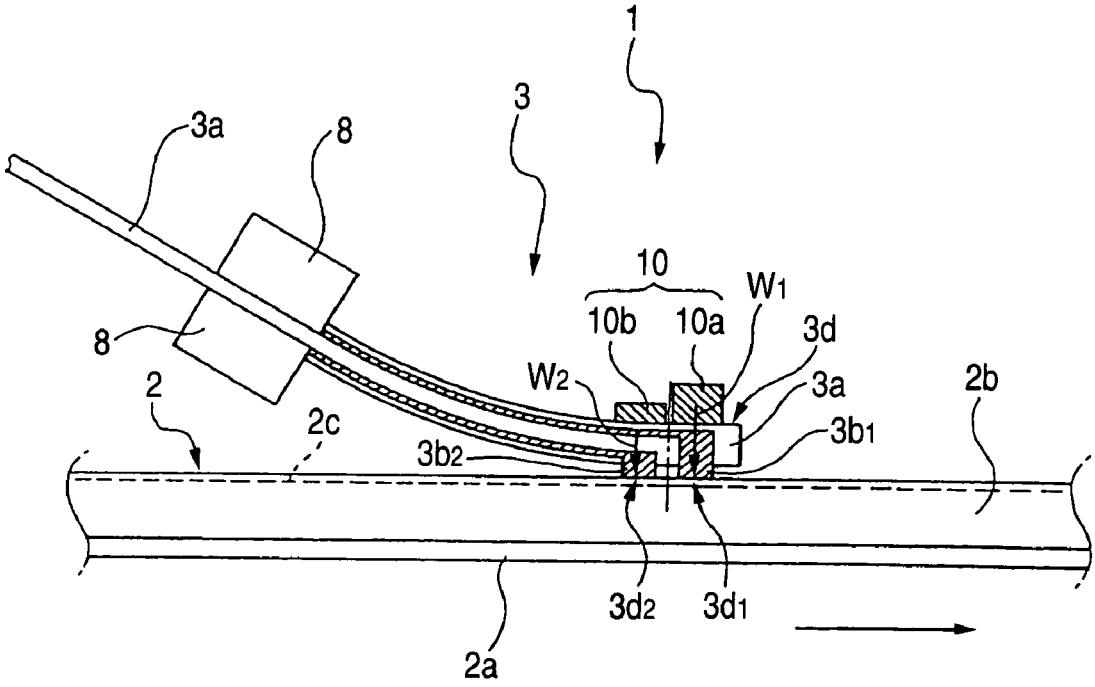
FIG. 15 is a schematic side view showing a writing device according to a twelfth embodiment of the invention.

FIG. 15 shows a twelfth embodiment of the invention. This embodiment is characterized in that the image carrier 2 is configured in the form of endless belt. This endless belt-type the image carrier 2 is, for example, suspended between a pair of pulleys arranged with a predetermined spacing (not shown in the figure), and circulates by driving either of the pulleys with a motor. The belt-type the image carrier 2 shown in FIG. 15 is circulated clockwise.

In this embodiment, individual electrode arrays 3*d*1, 3*d*2 are in contact with the flat portion of the belt between the pair of pulleys. In this manner, the stability in the contacts of electrode arrays 3*d*1, 3*d*2 with the image carrier 2 improves due to the fact that writing heads 3*d*1, 3*d*2 contact with the flat portion of the belt. The weight for the first array 10*a* and the one for the second array 10*b* are fabricated as separate members.

The protruded amount for the writing electrodes 3*b*1 arranged close to the free end of the substrate 3*a* may be made equal to that for the writing electrodes 3*b*2 arranged close to the fixed end of the substrate 3*a*. However, it is preferable to make the protruded amount of the writing electrodes 3*b*1 slightly longer than that for the writing electrodes 3*b*2. By fabricating the protruded amounts in such a manner, the same advantages can be obtained as described previously.

Any other configurations and attained advantages are the same as those described in the seventh embodiment.

Adoption of such an image carrier 2 in the form of endless belt can be applied to both of the tenth and eleventh embodiments.

Figure 16:
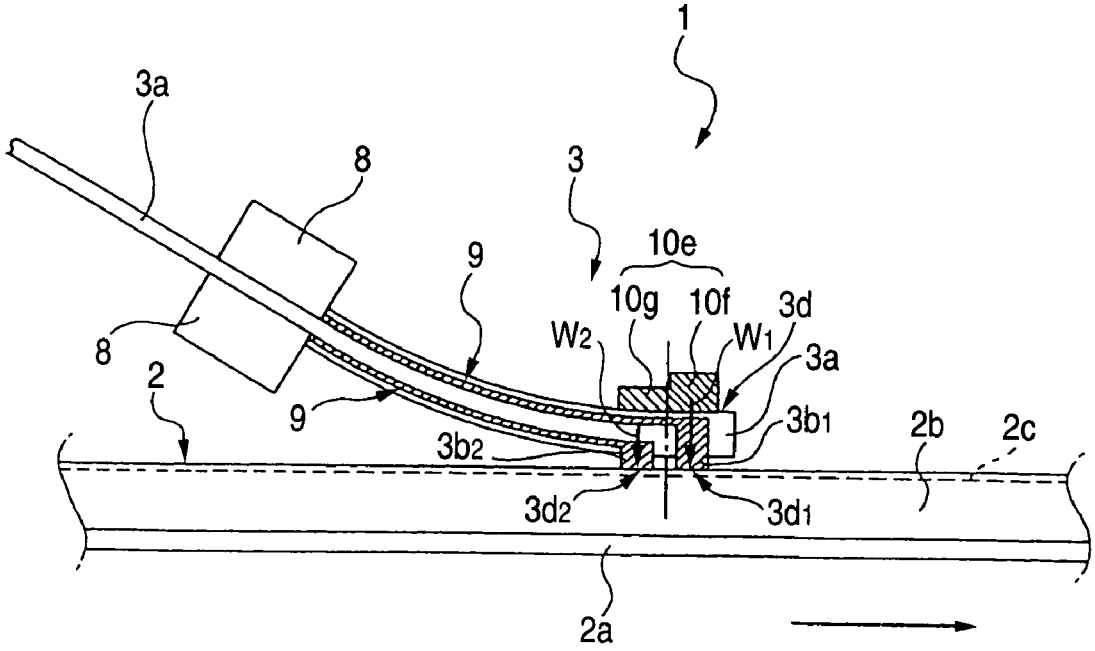
FIG. 16 is a schematic side view showing a writing device according to a thirteenth embodiment of the invention.

FIG. 16 shows a thirteenth embodiment of the invention. The embodiment is characterized in that the weights for the individual arrays are unified to a single weight 10*e*. The thickness of weight 10*e* changes so as to increase stepwise toward the downstream side of the advancing direction of the image carrier 2. Thus, a large thickness region 10*f* corresponds to the first electrode array 3*d*1, and a small thickness region 10*g* corresponds to the second electrode array 3*d*2. Therefore, loads W1 and W2 imparted to the individual writing heads 3*d*1, 3*d*2, respectively, by weight 10*e* are set so as to satisfy W2<W1.

Any other configurations and attained advantages are the same as those described in the twelfth embodiment.

The configuration of this embodiment be applied to all the seventh to tenth embodiments. Further, the weights for individual arrays may be fabricated in the form of an integral single member the thickness of which changes continuously as in the eleventh embodiment.

Figure 17:
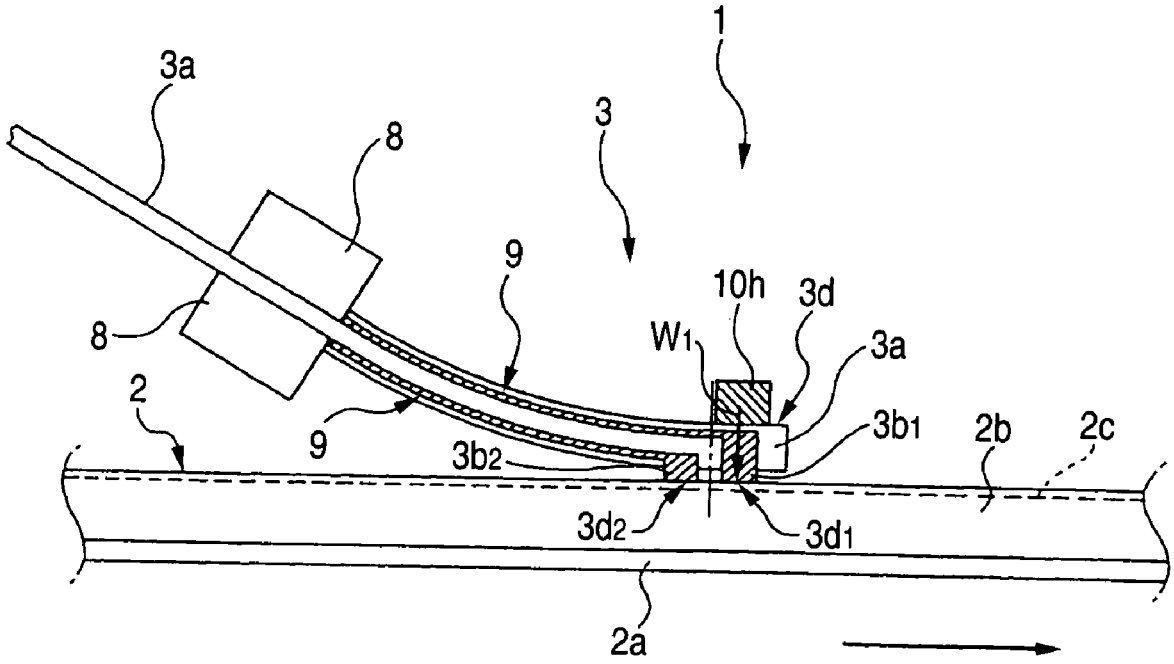
FIG. 17 is a schematic side view showing a writing device according to a fourteenth embodiment of the invention.

FIG. 17 shows a fourteenth embodiment of the invention. This embodiment is characterized in that a weight 10*h* is provided corresponding only to the first electrode array 3*d*1 (i.e., the writing head arranged closest to the free end of the substrate 3*a*). Accordingly, the load of weight 10*h* is mainly imparted to the first electrode array 3*d*1.

Since the size of the weight can be reduced along with the decrease of the number of weights, the space needed for fixing weight 10*h* onto the substrate 3*a* becomes small resulting in an increased degree of freedom for the fixing of weight 10*h*. At the same time, the fixing operation for weight 10*h* on the substrate 3*a* is simplified.

Any other configurations and attained advantages are the same as those described in the twelfth embodiment.

Provision of weights only for a part of the electrode arrays not for all of the arrays can be applied to any of the preceding embodiments. In a case where three or more electrode arrays are provided as in the tenth and eleventh embodiment, the weights can be provided so as to correspond to arbitrary electrode arrays except the one at the most-upstream side in the advancing direction of the image carrier 2.

Figure 18:
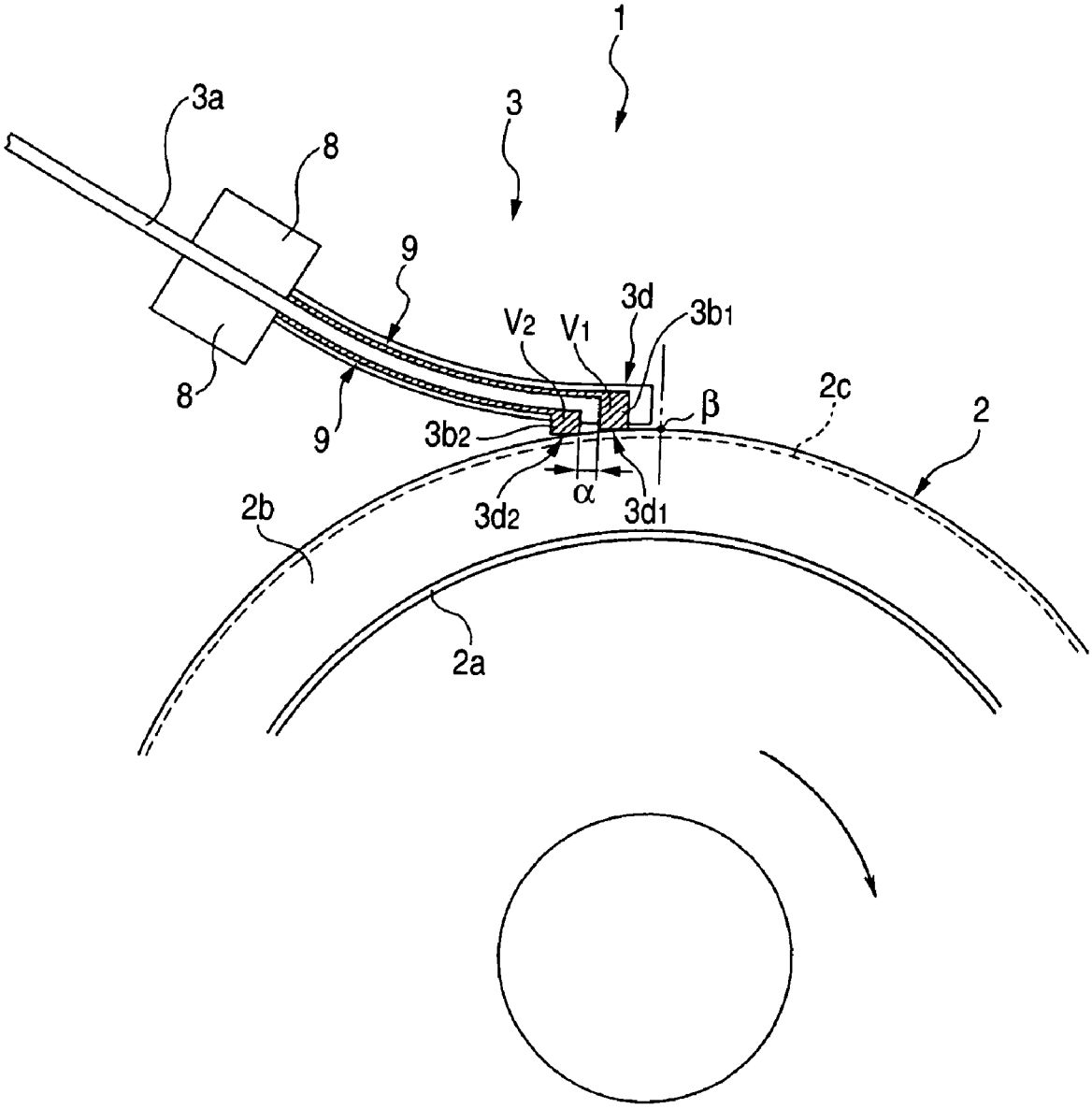
FIG. 18 is a schematic side view showing a writing device according to a fifteenth embodiment of the invention.

FIG. 18 shows a fifteenth embodiment of the invention. In this embodiment, to perform the normal development, the writing voltage Vim is applied to the respective writing electrodes 3*b*1, 3*b*2 associated with an image forming region such that an absolute value of the writing voltage Vim applied to the writing electrodes 3*b*2 closer to the fixed end of the substrate 3*a* is not greater than an absolute value of the writing voltage Vim applied to the writing electrodes 3*b*1.

On the other hand, the writing voltage Vnim is applied to the respective writing electrodes 3*b*1, 3*b*2 associated with a non-image forming region such that an absolute value of the writing voltage Vnim applied to the writing electrodes 3*b*2 closer to the fixed end of the substrate 3*a* Is not greater than an absolute value of the writing voltage Vnim applied to the writing electrodes 3*b*1. Here, the polarity of the writing voltage Vnim is opposite to the writing voltage Vim.

Numerical examples of the writing voltages Vim, Vnim as configured the above will be shown in Table 1.

TABLE 1

| example | Vim (V) | | Vnim (V) | | |
|---|---|---|---|---|---|
| No. | V1 | V2 | V1 | V2 | toner type |
| 1 | 350 | 300 | 0 | 0 | positive-charged |
| 2 | 300 | 280 | 0 | 0 | positive-charged |
| 3 | −350 | −300 | 0 | 0 | negative-charged |
| 4 | −300 | −280 | 0 | 0 | negative-charged |
| 5 | 350 | 300 | −20 | 0 | positive-charged |
| 6 | 350 | 300 | −20 | −10 | positive-charged |
| 7 | −350 | −300 | 20 | 0 | negative-charged |
| 8 | −350 | −300 | 20 | 10 | negative-charged |

The above numeric examples may be arbitrarily changed so long as the above relationships in connection with the absolute values are satisfied.

Further, the writing voltage Vnim may be arbitrarily determined so long as the writing voltage Vim satisfies the above relationship. However, in order to make the contact pressure between each writing head 3*d*1 or 3*d*2 of each array and image carrier 2 more effectively, it is preferable to configure the writing voltage Vnim so as to satisfy the above relationship.

In other words, in connection with the image forming region, the absolute value of the writing voltage applied to the writing electrodes 3*b*1 closer to the free end of the substrate 3*a* is no les than that applied to the writing electrodes 3*b*2 closer to the fixed end of the substrate 3*a*. Accordingly, an electrostatic force generated between the writing electrodes 3*b*1 and the image carrier 2 becomes no less than that generated between the writing electrodes 3*b*2 and the image carrier 2. As a result, the difference between the contact forces of the writing electrodes 3*b*1, 3*b*2 with respect to the image carrier 2 is canceled. Since the contact resistances of the writing electrodes 3*b*1, 3*b*2 with respect to the image carrier 2 are made substantially identical with each other, an uniform electrostatic latent image can be formed. Performing the normal development with this uniform latent image, a final image with high quality can be stably obtained.

Also in the non-image forming region, according to the above described configuration, the difference between the contact forces of the writing electrodes 3*b*1, 3*b*2 with respect to the image carrier 2 is canceled. This also contributes the formation of uniform electrostatic latent image.

Further, since the protruded amount of the writing electrodes 3*b*2 from the substrate 3*a* is set larger than protruded amount of the writing electrode 3*b*1 from the substrate 3*a*, in accordance with the outer peripheral shape of the image carrier 2, the difference between the contact forces of the writing electrodes 3*b*1, 3*b*2 with respect to the image carrier 2 is canceled more effectively.

Figure 19:
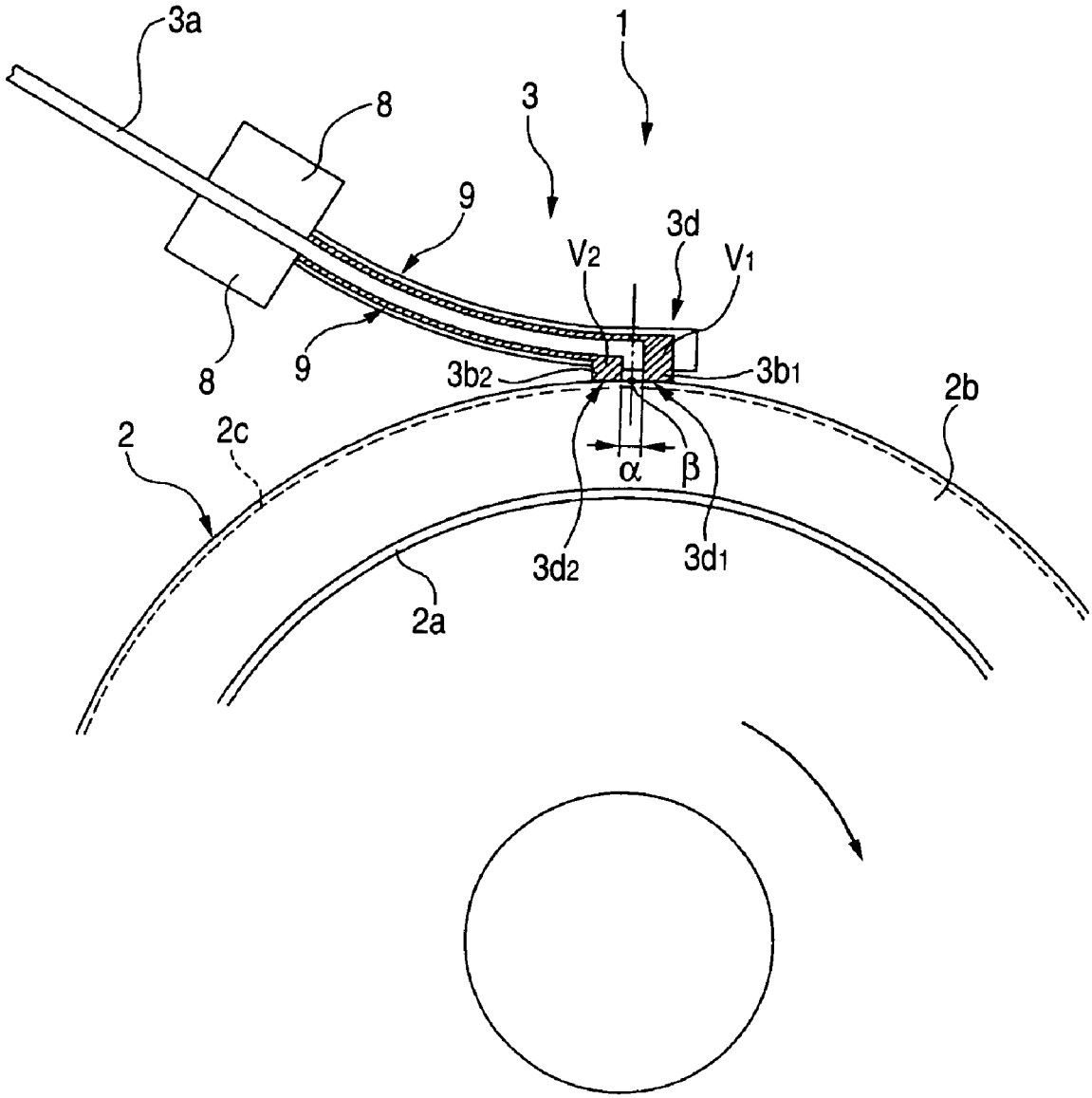
FIG. 19 is a schematic side view showing a writing device according to a sixteenth embodiment of the invention.

FIG. 19 shows a sixteenth embodiment of the invention. This embodiment is characterized in that the center of the spacing α between writing heads 3*d*1, 3*d*2 is positioned at the highest point β of the image carrier 2. Accordingly, the first electrode array 3*d*1 contacts with the image carrier 2 at the downstream side of the highest point β in the advancing direction, and the second electrode array 12 contacts with the image carrier 2 at the upstream side of the highest point β in the advancing direction.

The writing voltages Vim and Vnim applied to the respective writing electrodes 3*b*1, 3*b*2 are configured as well as the fifteenth embodiment.

In this embodiment, the protruded amounts of the writing electrodes 3*b*1, 3*b*2 may be made almost equal to each other.

However, as described the above, by using the second electrode array 3d2 in contact with the image carrier 2 as a support point, the substrate 3a at the gap between electrode arrays 3d1, 3d2 act to separate the first electrode array 3d1 from the image carrier 2. Thus, it is preferable to make the protruded amount of the writing electrodes 3b1 in the first array slightly longer than protruded amount of the writing electrodes 3b2 in the second array. By fabricating the protruded amounts in such a manner, the contact pressure between each writing head 3d1 or 3d2 and the image carrier 2 can be made uniform more effectively.

Any other configurations and attained advantages are the same as those described in the fifteenth embodiment.

Figure 20:
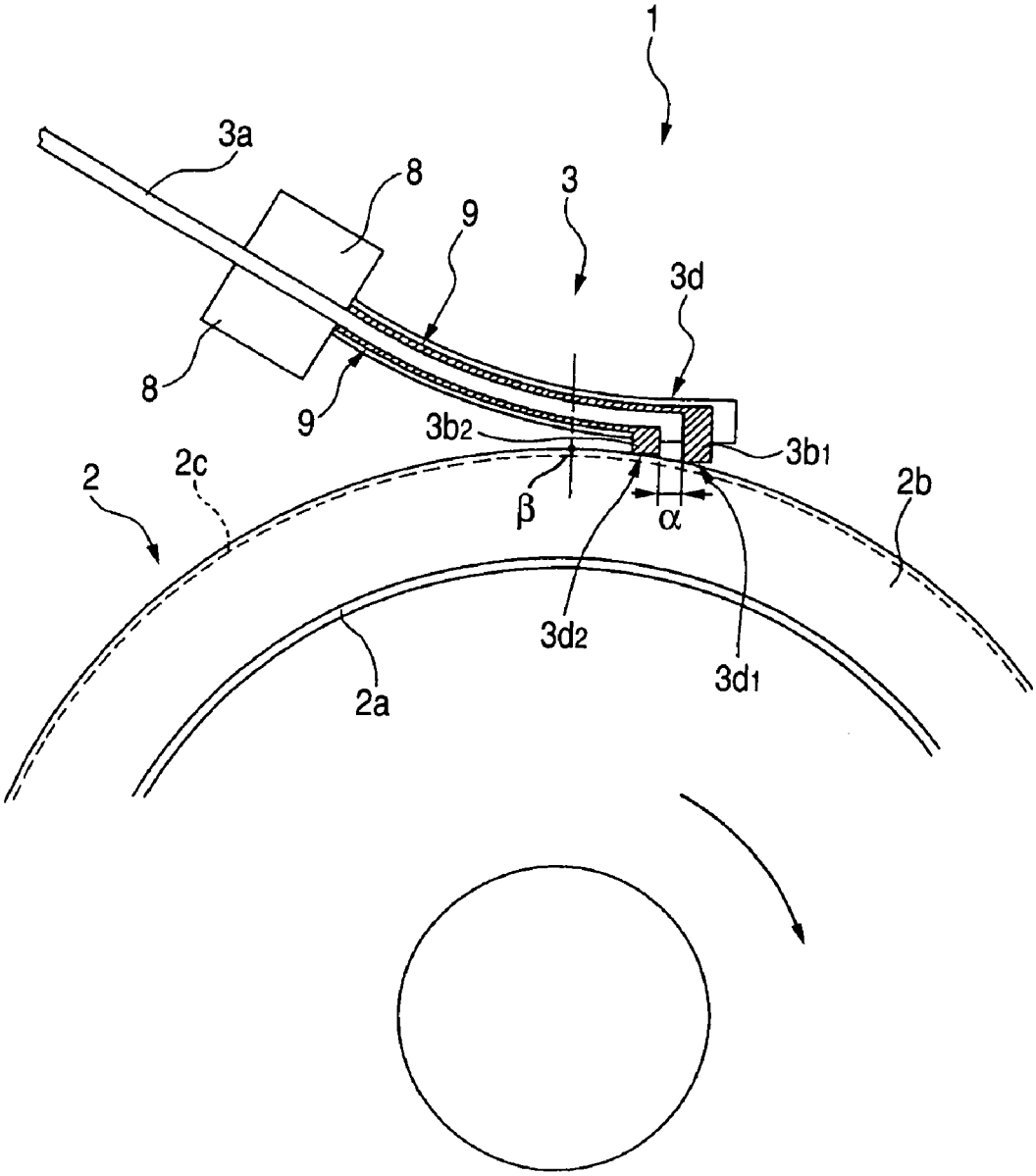
FIG. 20 is a schematic side view showing a writing device according to a seventeenth embodiment of the invention.

FIG. 20 shows a seventeenth embodiment of the invention. This embodiment is characterized in that both of electrode arrays 3d1, 3d2 are in contact with the image carrier 2 at the downstream side of the uppermost point β of the carrier in the advancing direction.

The writing voltages Vim and Vnim applied to the respective writing electrodes 3b1, 3b2 are configured as well as the fifteenth embodiment.

In this embodiment, the protruded amount for the writing electrodes 3b1 in the first array is preferably made longer than that for the writing electrodes 3b2 in the second array. By fabricating the protruded amounts in such a manner, the contact pressure between each writing head 3d1 or 3d2 and the image carrier 2 is made uniform more effectively.

Any other configurations and attained advantages are the same as those described in the fifteenth embodiment.

Figure 21:
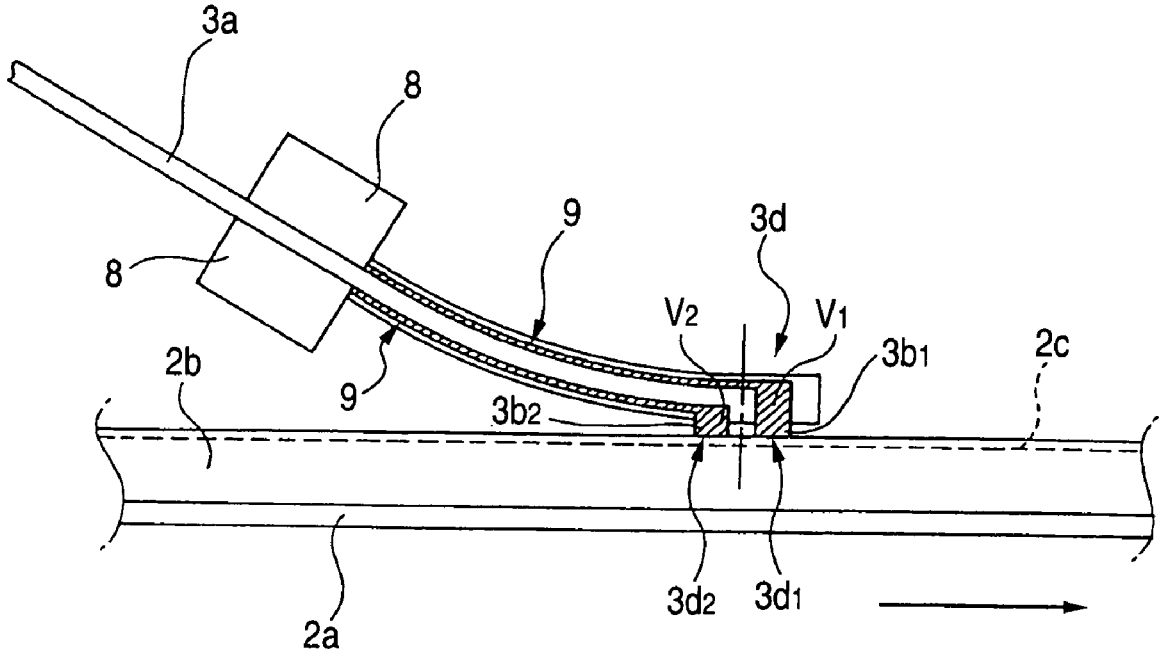
FIG. 21 is a schematic side view showing a writing device according to an eighteenth embodiment of the invention.

FIG. 21 shows an eighteenth embodiment of the invention. This embodiment is characterized in that the image carrier 2 is configured in the form of endless belt. This endless belt-type the image carrier 2 is, for example, suspended between a pair of pulleys arranged with a predetermined spacing (not shown in the figure), and circulates by driving either of the pulleys with a motor. The belt-type the image carrier 2 shown in FIG. 21 is circulated clockwise.

The writing voltages Vim and Vnim applied to the respective writing electrodes 3b1, 3b2 are configured as well as the fifteenth embodiment.

The protruded amount for the writing electrodes 3b1 arranged close to the free end of the substrate 3a may be made equal to that for the writing electrodes 3b2 arranged dose to the fixed end of the substrate 3a. However, it is preferable to make the protruded amount of the writing electrodes 3b1 slightly longer than that for the writing electrodes 3b2. By fabricating the protruded amounts in such a manner, the same advantages can be obtained as described previously.

Any other configurations and attained advantages are the same as those described in the fifteenth embodiment.

This invention is not limited to the adoption of the image forming apparatus shown in FIG. 2, which performs the normal developing. So long as the writing device according to any one of the fifteenth through eighteenth embodiments can be incorporated, any type of image forming apparatus can be adopted.

For example, as a nineteenth embodiment of the invention, an image forming apparatus which performs a reversal development may be adopted. The basic configuration of this apparatus is substantially the same as that shown in FIG. 2. Also in this case, both of positively and negatively charged toners can be used.

In this embodiment, the writing voltage Vnim is applied to the respective writing electrodes 3b1, 3b2 associated with a non-image forming region such that an absolute value of the writing voltage Vnim applied to the writing electrodes 3b2 closer to the fixed end of the substrate 3a is not greater than an absolute value of the writing voltage Vnim applied to the writing electrodes 3b1.

On the other hand, the writing voltage Vim is applied to the respective writing electrodes 3b1, 3b2 associated with an image forming region such that an absolute value of the writing voltage Vim applied to the writing electrodes 3b2 closer to the fixed end of the substrate 3a is not greater than an absolute value of the writing voltage Vim applied to the writing electrodes 3b1. Here, the polarity of the writing voltage Vim is opposite to the writing voltage Vnim.

Numerical examples of the writing voltages Vnim, Vim as configured the above will be shown in Table 2.

TABLE 2

| example | Vnim (V) | | Vim (V) | | |
|---|---|---|---|---|---|
| No. | V1 | V2 | V1 | V2 | toner type |
| 9 | 350 | 300 | 0 | 0 | positive-charged |
| 10 | 300 | 280 | 0 | 0 | positive-charged |
| 11 | −350 | −300 | 0 | 0 | negative-charged |
| 12 | −300 | −280 | 0 | 0 | negative-charged |
| 13 | 350 | 300 | −20 | 0 | positive-charged |
| 14 | 350 | 300 | −20 | −10 | positive-charged |
| 15 | −350 | −300 | 20 | 0 | negative-charged |
| 16 | −350 | −300 | 20 | 10 | negative-charged |

The above numeric examples may be arbitrarily changed so long as the above relationships in connection with the absolute values are satisfied.

Further, the writing voltage Vim may be arbitrarily determined so long as the writing voltage Vnim satisfies the above relationship. However, in order to make the contact pressure between each writing head 3d1 or 3d2 of each array and image carrier 2 more effectively, it is preferable to configure the writing voltage Vim so as to satisfy the above relationship.

In other words, in connection with the non-image forming region, the absolute value of the writing voltage applied to the writing electrodes 3b1 closer to the free end of the substrate 3a is no less than that applied to the writing electrodes 3b2 closer to the fixed end of the substrate 3a. Accordingly, an electrostatic force generated between the writing electrodes 3b1 and the image carrier 2 becomes no less than that generated between the writing electrodes 3b2 and the image carrier 2. As a result the difference between the contact forces of the writing electrodes 3b1, 3b2 with respect to the image carrier 2 is canceled. Since the contact resistances of the writing electrodes 3b1, 3b2 with respect to the image carrier 2 are made substantially identical with each other, an uniform electrostatic latent image can be formed. Performing the reversal development with this uniform latent image, a final image with high quality can be stably obtained.

Also in the image forming region, according to the above described configuration, the difference between the contact forces of the writing electrodes 3b1, 3b2 with respect to the image carrier 2 is canceled. This also contributes the formation of uniform electrostatic latent image.

Figure 22:
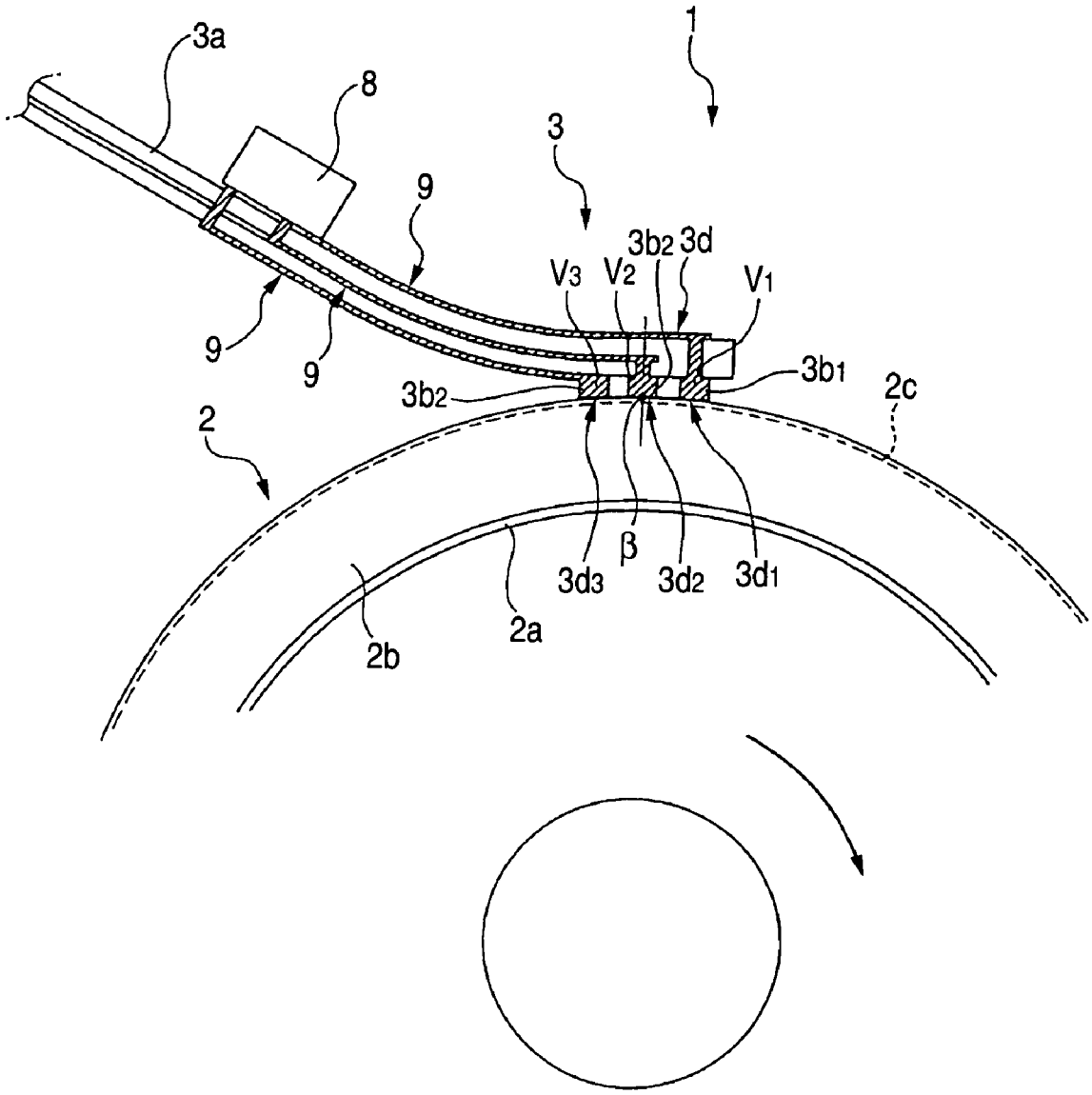
FIG. 22 is a schematic side view showing a writing device according to a twentieth embodiment of the invention.

FIG. 22 shows a twentieth embodiment of the invention. This embodiment is characterized in that three electrode arrays 3d1, 3d2 and 3d3 are provided on the substrate 3a with a predetermined spacing in the advancing direction of the image carrier 2. The center of writing head 3d in the advancing direction of the image carrier 2 (i.e., the center of the second electrode array 3d2 in the advancing direction of the image carrier 2) is positioned at the highest point β of the image carrier 2. Accordingly, the first electrode array 3*d*1 contacts with the image carrier 2 at the downstream side of the highest point β in the advancing direction, the second electrode array 3*d*2 contacts with the image carrier 2 at the highest point β of the image carrier 2, and the third electrode array 3*d*3 contacts with the image carrier 2 at the upstream side of the highest point β in the advancing direction.

Each electrode array 3*d*1, 3*d*2 or 3*d*3 has plural the writing electrodes 3*b*1, 3*b*2 or 3*b*3 aligned in the axial direction of the image carrier 2. The arrangements shown in FIGS. 13A and 13B may be adopted. Any other arrangement may be adopted so long as the adjacent electrodes are partly overlapped when viewed from the advancing direction of the image carrier 2.

Each the writing electrode 3*b*1, 3*b*2 or 3*b*3 is electrically connected to the driver 8 by the wiring patterns 9.

In the embodiment, the protruded amounts of the writing electrodes 3*b*1, 3*b*2 and 3*b*3 in electrode arrays 3*d*1, 3*d*2 and 3*d*3 may be made almost equal to each other. However, it is preferable to make the protruded amounts of the writing electrodes 3*b*1 and 3*b*3 in the first and third arrays slightly longer than protruded amount of the writing electrodes 3*b*2 in the second array, in accordance with the outer peripheral shape of the image carrier 2. By fabricating the protruded amounts in such a manner, the contact pressure between each writing head 3*d*1, 3*d*2 or 3*d*3 and the image carrier 2 can be equalized more effectively.

In this embodiment, to perform the normal development, the writing voltage Vim is applied to the respective writing electrodes 3*b*1, 3*b*2 and 3*b*3 associated with an image forming region such that an absolute value of the writing voltage Vim applied to the writing electrodes 3*b*3 closest to the fixed end of the substrate 3*a* is not greater than an absolute value of the writing voltage Vim applied to the writing electrodes 3*b*1, 3*b*2.

On the other hand, the writing voltage Vnim is applied to the respective writing electrodes 3*b*1, 3*b*2 and 3*b*3 associated with a non-image forming region such that an absolute value of the writing voltage Vnim applied to the writing electrodes 3*b*3 closest to the fixed end of the substrate 3*a* is not greater than an absolute value of the writing voltage Vnim applied to the writing electrodes 3*b*1, 3*b*2. Here, the polarity of the writing voltage Vnim is opposite to the writing voltage Vim.

Numerical examples of the writing voltages Vim, Vnim as configured the above will be shown in Table 3.

TABLE 3

| example | Vim (V) | | Vnim (V) | | |
|---|---|---|---|---|---|
| No. | V1, V2 | V3 | V1, V2 | V3 | toner type |
| 17 | 350 | 300 | 0 | 0 | positive-charged |
| 18 | 300 | 280 | 0 | 0 | positive-charged |
| 19 | −350 | −300 | 0 | 0 | negative-charged |
| 20 | −300 | −280 | 0 | 0 | negative-charged |
| 21 | 350 | 300 | −20 | 0 | positive-charged |
| 22 | 350 | 300 | −20 | −10 | positive-charged |
| 23 | −350 | −300 | 20 | 0 | negative-charged |
| 24 | −350 | −300 | 20 | 10 | negative-charged |

The above numeric examples may be arbitrarily changed so long as the above relationships in connection with the absolute values are satisfied.

Further, the writing voltages V1 and V2 may be different from each other. In this case, it is preferable that the absolute value of the writing voltage V1 is made greater than the absolute value of the writing voltage V2.

Further, the writing voltage Vnim may be arbitrarily determined so long as the writing voltage Vim satisfies the above relationship. However, in order to make the contact pressure between each writing head 3*d*1, 3*d*2 or 3*d*3 of each array and image carrier 2 more effectively, it is preferable to configure the writing voltage Vnim so as to satisfy the above relationship.

In other words, in connection with the image forming region, the absolute value of the writing voltage applied to the writing electrodes 3*b*1, 3*b*2 closer to the free end of the substrate 3*a* is no less than that applied to the writing electrodes 3*b*3 closest to the fixed end of the substrate 3*a*. Accordingly, electrostatic forces generated between the writing electrodes 3*b*1, 3*b*2 and the image carrier 2 becomes no less than that generated between the writing electrodes 3*b*3 and the image carrier 2. As a result, the difference between the contact forces of the writing electrodes 3*b*1, 3*b*2 and 3*b*3 with respect to the image carrier 2 is canceled. Since the contact resistances of the writing electrodes 3*b*1, 3*b*2 and 3*b*3 with respect to the image carrier 2 are made substantially identical with each other, an uniform electrostatic latent image can be formed. Performing the normal development with this uniform latent image, a final image with high quality can be stably obtained.

Also in the non-image forming region, according to the above described configuration, the difference between the contact forces of the writing electrodes 3*b*1, 3*b*2 and 3*b*3 with respect to the image carrier 2 is canceled. This also contributes the formation of uniform electrostatic latent image.

Further, since the protruded amount of the writing electrodes 3*b*1 and 3*b*3 from the substrate 3*a* is set larger than protruded amount of the writing electrode 3*b*2 from the substrate 3*a*, in accordance with the outer peripheral shape of the image carrier 2, the difference between the contact forces of the writing electrodes 3*b*1, 3*b*2 and 3*b*3 with respect to the image carrier 2 is canceled more effectively.

As a twenty-first embodiment of the invention, an image forming apparatus which performs a reversal development may be adopted. The basic configuration of this apparatus is substantially the same as that shown in FIG. 2. Also in this case, both of positively and negatively charged toners can be used.

In this embodiment, to perform the reversal development, the writing voltage Vnim is applied to the respective writing electrodes 3*b*1, 3*b*2 and 3*b*3 associated with a non-image forming region such that an absolute value of the writing voltage Vnim applied to the writing electrodes 3*b*3 closest to the fixed end of the substrate 3*a* is not greater than an absolute value of the writing voltage Vnim applied to the writing electrodes 3*b*1, 3*b*2.

On the other hand, the writing voltage Vim is applied to the respective writing electrodes 3*b*1, 3*b*2 and 3*b*3 associated with an image forming region such that an absolute value of the writing voltage Vim applied to the writing electrodes 3*b*3 closest to the fixed end of the substrate 3*a* is not greater than an absolute value of the writing voltage Vim applied to the writing electrodes 3*b*1, 3*b*2. Here, the polarity of the writing voltage Vim is opposite to the writing voltage Vnim.

Numerical examples of the writing voltages Vnim, Vim as configured the above will be shown in Table 4.

TABLE 4

| example | Vnim (V) | | Vim (V) | | |
|---|---|---|---|---|---|
| No. | V1, V2 | V3 | V1, V2 | V3 | toner type |
| 25 | 350 | 300 | 0 | 0 | positive-charged |
| 26 | 300 | 280 | 0 | 0 | positive-charged |
| 27 | −350 | −300 | 0 | 0 | negative-charged |
| 28 | −300 | −280 | 0 | 0 | negative-charged |
| 29 | 350 | 300 | −20 | 0 | positive-charged |
| 30 | 350 | 300 | −20 | −10 | positive-charged |
| 31 | −350 | −300 | 20 | 0 | negative-charged |
| 32 | −350 | −300 | 20 | 10 | negative-charged |

Further, the writing voltage Vim may be arbitrarily determined so long as the writing voltage Vnim satisfies the above relationship. However, in order to make the contact pressure between each writing head 3*d*1, 3*d*2 or 3*d*3 of each array and image carrier 2 more effectively, it is preferable to configure the writing voltage Vim so as to satisfy the above relationship.

In other words, in connection with the image forming region, the absolute value of the writing voltage applied to the writing electrodes 3*b*1, 3*b*2 closer to the free end of the substrate 3*a* is no less than that applied to the writing electrodes 3*b*3 closest to the fixed end of the substrate 3*a*. Accordingly, electrostatic forces generated between the writing electrodes 3*b*1, 3*b*2 and the image carrier 2 becomes no less than that generated between the writing electrodes 3*b*3 and the image carrier 2. As a result, the difference between the contact forces of the writing electrodes 3*b*1, 3*b*2 and 3*b*3 with respect to the image carrier 2 is canceled. Since the contact resistances of the writing electrodes 3*b*1, 3*b*2 and 3*b*3 with respect to the image carrier 2 are made substantially identical with each other, an uniform electrostatic latent image can be formed. Performing the reversal development with this uniform latent image, a final image with high quality can be stably obtained.

Also in the image forming region, according to the above described configuration, the difference between the contact forces of the writing electrodes 3*b*1, 3*b*2 and 3*b*3 with respect to the image carrier 2 is canceled. This also contributes the formation of uniform electrostatic latent image.

Although the present invention has been shown and described with reference to specific preferred embodiments, various changes and modifications will be apparent to those skilled in the art form the teachings herein. Such changes and modifications as are obvious are deemed to come within the spirit, scope and contemplation of the invention as defined in the appended claims.

What is claimed is:

1. A head device, for writing an electrostatic latent image on an image carrier of an image forming apparatus which is movable in a first direction, the head device comprising:

a flexible substrate;

a plurality of writing electrodes, arrayed on the substrate in a second direction perpendicular to the first direction to form a plurality of electrode arrays which are arranged in the first direction, the writing electrodes being brought into contact with the image carrier with a flexibility of the substrate;

a head driver, disposed on the substrate; and a plurality of wirings, extending in the first direction to connect the head driver and the respective writing electrodes to supply writing voltages from the head driver to the writing electrodes, wherein at least one of the wirings extended through one of the writing electrodes in one of the electrode arrays is placed between adjacent ones of the writing electrodes in another one of the electrode arrays.

2. The head device as set forth in claim 1, wherein the number of wirings situated between a portion between the plural electrode arrays is identical with the number of wirings situated between a portion between the head driver and one of the plural electrode arrays.

3. An image forming apparatus, comprising:

an image carrier on which an electrostatic latent image to be developed as a visible image is formed; and the head device as set forth in claim 1, operable to write the electrostatic latent image on the image carrier.

* * * * *